US011365952B2

(12) United States Patent
Hopkins et al.

(10) Patent No.: US 11,365,952 B2
(45) Date of Patent: Jun. 21, 2022

(54) FIREARM STOCK WITH ADJUSTABLE BUTT PLATE AND LOCKING COMB ASSEMBLY

(71) Applicant: Sig Sauer, Inc., Newington, NH (US)

(72) Inventors: David B. Hopkins, Exeter, NH (US); Matteo V. Viviano, Harrison Township, MI (US)

(73) Assignee: Sig Sauer, Inc., Newington, NH (US)

( * ) Notice: Subject to any disclaimer, the term of this patent is extended or adjusted under 35 U.S.C. 154(b) by 56 days.

(21) Appl. No.: 16/993,871

(22) Filed: Aug. 14, 2020

(65) Prior Publication Data

US 2021/0048274 A1 Feb. 18, 2021

Related U.S. Application Data

(60) Provisional application No. 62/887,946, filed on Aug. 16, 2019.

(51) Int. Cl.
*F41C 23/14* (2006.01)

(52) U.S. Cl.
CPC ..... *F41C 23/14* (2013.01)

(58) Field of Classification Search
CPC ..... F41C 23/14; F41C 23/04
See application file for complete search history.

(56) References Cited

U.S. PATENT DOCUMENTS 1,651,299 A 11/1927 Stansel
2,424,194 A 7/1947 Sampson et al.
2,970,398 A 2/1961 Crouch
3,201,887 A 8/1965 Sedelow
3,369,316 A 2/1968 Miller
3,488,488 A 1/1970 Crouch
3,618,584 A 11/1971 Pigeon
4,512,236 A 4/1985 Thevis et al.
4,617,749 A 10/1986 Jurek
4,735,007 A 4/1988 Gal
5,149,899 A 9/1992 Dabrowski
5,209,215 A 5/1993 Morrison
(Continued)

OTHER PUBLICATIONS

"Buttstocks," FAB Defense Online Catalog, https://www.fab-defense.com/en/category-buttstocks.html (last visited Nov. 8, 2018).
(Continued)

*Primary Examiner* — J. Woodrow Eldred
(74) *Attorney, Agent, or Firm* — Finch & Maloney PLLC

(57) ABSTRACT

A firearm stock with adjustable length of pull and/or comb height is disclosed. In one example, a butt plate assembly includes a tongue defining top and bottom chamfered outside edges. A stock body defines top and bottom chamfered inside edges along a slot opening. Moving a locking assembly to a locked position draws the chamfered outside edges on the tongue against the chamfered inside edges along the slot opening. A locking plate can be used between the fastener and the tongue. In another example, an adjustable comb assembly includes a cheek plate with posts received in post openings that extend into the stock body. A locking lever is coupled to a fastener that extends laterally through the stock body. Moving the lever to the locked position draws together opposite sides of the stock body to constrain the post openings, thereby retaining the position of the comb.

18 Claims, 14 Drawing Sheets

(56) References Cited

U.S. PATENT DOCUMENTS

| | | | |
|---|---|---|---|
| D344,124 | S | 2/1994 | Cupp |
| 5,392,553 | A | 2/1995 | Cary |
| D410,988 | S | 6/1999 | Hines |
| 5,933,997 | A | 8/1999 | Barrett |
| 5,970,642 | A | 10/1999 | Martin |
| 5,983,774 | A | 11/1999 | Mihaita |
| 6,779,289 | B2 | 8/2004 | Kay |
| 6,839,998 | B1 | 1/2005 | Armstrong |
| D510,401 | S | 10/2005 | Murello et al. |
| 7,418,797 | B1 | 9/2008 | Crose |
| D600,310 | S | 9/2009 | Fitzpatrick et al. |
| D606,155 | S | 12/2009 | Swan |
| D606,156 | S | 12/2009 | Swan |
| 7,685,757 | B2 | 3/2010 | Rohrauer |
| D622,802 | S | 8/2010 | Fitzpatrick et al. |
| 7,793,453 | B1 | 9/2010 | Sewell, Jr. et al. |
| 7,798,045 | B1 | 9/2010 | Fitzpatrick et al. |
| 7,827,722 | B1 | 11/2010 | Davies |
| D636,044 | S | 4/2011 | Larson et al. |
| D636,048 | S | 4/2011 | Larson et al. |
| 7,966,761 | B1 | 6/2011 | Kuczynko et al. |
| D641,062 | S | 7/2011 | Faifer |
| 7,984,580 | B1 | 7/2011 | Giauque et al. |
| 8,061,072 | B1 | 11/2011 | Crose |
| 8,109,026 | B1 | 2/2012 | Bentley et al. |
| 8,151,504 | B1 | 4/2012 | Aiston |
| 8,186,090 | B1 | 5/2012 | Chiarolanza et al. |
| 8,245,429 | B2 | 8/2012 | Kuczynko et al. |
| D671,184 | S | 11/2012 | Larson et al. |
| 8,307,575 | B1 | 11/2012 | Battaglia |
| D674,859 | S | 1/2013 | Robbins et al. |
| 8,443,538 | B1 | 5/2013 | Moody |
| 8,448,366 | B2 | 5/2013 | Faifer |
| 8,522,467 | B1 | 9/2013 | Christensen et al. |
| D692,084 | S | 10/2013 | Eberle |
| D692,517 | S | 10/2013 | Faifer |
| D696,374 | S | 12/2013 | Faifer |
| 8,631,601 | B2 | 1/2014 | Langevin et al. |
| 8,667,882 | B1 | 3/2014 | Larson et al. |
| D702,792 | S | 4/2014 | Burt et al. |
| 8,726,558 | B1 | 5/2014 | Nason |
| 8,769,855 | B2 | 7/2014 | Law |
| D714,413 | S | 9/2014 | Kerbrat et al. |
| 8,844,185 | B2 | 9/2014 | Jarboe |
| D716,403 | S | 10/2014 | Burt et al. |
| D724,688 | S | 3/2015 | Hirt et al. |
| D725,213 | S | 3/2015 | Hirt et al. |
| D725,219 | S | 3/2015 | Hirt et al. |
| D725,220 | S | 3/2015 | Hirt et al. |
| 8,984,790 | B2 | 3/2015 | Wilson et al. |
| D731,023 | S | 6/2015 | Hirt et al. |
| D733,223 | S | 6/2015 | Chu |
| 9,097,490 | B2 | 8/2015 | Tseng |
| D744,056 | S | 11/2015 | Jammet |
| 9,297,609 | B2 | 3/2016 | Burt |
| 9,360,272 | B2 | 6/2016 | Hopkins |
| 9,453,701 | B2 | 9/2016 | Simek |
| 9,464,863 | B2 | 10/2016 | Mather et al. |
| D773,591 | S | 12/2016 | Morenz |
| D773,593 | S | 12/2016 | Hopkins et al. |
| 9,574,844 | B2 | 2/2017 | Williams |
| 9,664,476 | B1 | 5/2017 | Robinson et al. |
| 9,664,478 | B2 | 5/2017 | Robinson et al. |
| 9,664,479 | B1 | 5/2017 | Robinson et al. |
| 10,012,470 | B2 | 7/2018 | Johnson |
| 10,215,526 | B2 | 2/2019 | Shinkle et al. |
| 10,458,746 | B2 | 10/2019 | Frazier et al. |
| 2005/0108915 | A1 | 5/2005 | Kincel |
| 2006/0242880 | A1 | 11/2006 | Griffin |
| 2006/0254111 | A1 | 11/2006 | Giauque et al. |
| 2007/0056202 | A1 | 3/2007 | Oz |
| 2008/0028662 | A1 | 2/2008 | Abraham et al. |
| 2008/0236016 | A1 | 10/2008 | Fitzpatrick et al. |
| 2009/0282718 | A1 | 11/2009 | Bartley |
| 2009/0288324 | A1 | 11/2009 | Peterson et al. |
| 2010/0071246 | A1 | 3/2010 | Vesligai |
| 2010/0186276 | A1 | 7/2010 | Herring |
| 2010/0212205 | A1 | 8/2010 | Nill |
| 2011/0283581 | A1 | 11/2011 | Freed |
| 2011/0283584 | A1 | 11/2011 | Walters |
| 2012/0017482 | A1 | 1/2012 | Chvala |
| 2012/0137562 | A1 | 6/2012 | Langevin et al. |
| 2012/0159828 | A1 | 6/2012 | Jarboe et al. |
| 2012/0180354 | A1 | 7/2012 | Sullivan et al. |
| 2013/0125442 | A1 | 5/2013 | Burress |
| 2013/0180148 | A1 | 7/2013 | Rogers et al. |
| 2013/0212920 | A1 | 8/2013 | Law |
| 2013/0312920 | A1 | 11/2013 | Mullet et al. |
| 2014/0033590 | A1 | 2/2014 | Gomez |
| 2014/0075816 | A1 | 3/2014 | Larson et al. |
| 2014/0190055 | A1 | 7/2014 | Warburton |
| 2014/0196343 | A1 | 7/2014 | Wilson et al. |
| 2014/0196346 | A1 | 7/2014 | Grimshaw et al. |
| 2014/0245649 | A1 | 9/2014 | Fluhr et al. |
| 2014/0259848 | A1 | 9/2014 | Chvala |
| 2014/0260946 | A1 | 9/2014 | Gomez |
| 2015/0219416 | A1 | 8/2015 | Chvala |
| 2015/0345895 | A1 | 12/2015 | Young |
| 2016/0025448 | A1 | 1/2016 | Kincel |
| 2016/0061559 | A1 | 3/2016 | Wood et al. |
| 2016/0084612 | A1 | 3/2016 | Robinson et al. |
| 2016/0178305 | A1 | 6/2016 | Ellis et al. |
| 2016/0202016 | A1 | 7/2016 | Mather et al. |
| 2017/0356718 | A1 | 12/2017 | Johnson |
| 2018/0073835 | A1 | 3/2018 | Saltzman |
| 2018/0202756 | A1* | 7/2018 | Shinkle ..... F41C 23/14 |
| 2018/0335273 | A1 | 11/2018 | Doty et al. |
| 2022/0074702 | A1* | 3/2022 | Levi ..... F41C 23/04 |

OTHER PUBLICATIONS

CAA AR-15 Adjustable Cheek Piece Picatinny Mount Polymer Black ACP, Cheaper Than Dirt Online Catalog, https://www.cheaperthandirt.com/product/command-arms-accessories-adjustable-cheek-piece-for-cbs-stock-polymer-black-acp-814716012710.do (last visited Nov. 19, 2018).

"MAKO GLR16 Buttstock," Midway USA Online Catalog, https://www.midwayusa.com/product/318705/mako-glr16-buttstock-with-adjustable-cheek-rest-collapsible-ar-15-lr-308-carbine-synthetic (last visited Nov. 8, 2018).

"Collapsing/Telescoping Stock for MCX MPX," Rainier Arms Website, https://www.rainierarms.com/sig-sauer-x-collapsible-stock-for-mcx-mpx (last visited Sep. 30, 2016).

Sig Sauer MPX Forum, SIGforum.com, http://sigforum.eom/eve/forums/a/tpc/f/320601935/m/4610068653 (last visited Sep. 30, 2016).

Max Slowik, "Are These the New SIG 556 Rifles for 2014?," Guns.com, http://www.guns.com/2014/01 /08/new-sig-556-rifles-2014 (Jan. 8, 2014).

"Stock, Folding, MPX, 1913 Interface," Bullzie.com, https://www.bullzie.com/product/stock-folding-mpx-1913-interface/ (last visited Sep. 30, 2016).

"Sig Sauer Telescoping/Folding Stock, MCX, MPX, BLK," Sig Sauer Store, http://store.sigsauer.com/sig-sauer-side-folding-and-telescoping-stock-mcx-mpx.html (last visited Sep. 30, 2016).

"Telescoping/Folding Stock for the SIG MPX and SIG MCX" YouTube.com, https://www.youtube.com/watch?v=4nayEomcEKg&feature=youtu.be (posted Dec. 11, 2015) (last visited Sep. 30, 2016).

"MDM—SIG SAUER," Soldier Systems Daily, http://soldiersystems.net/2015/09/23/mdm-sig-sauer/ (Sept. 23, 2015) (last visited Sep. 30, 2016).

* cited by examiner

FIREARM STOCK WITH ADJUSTABLE BUTT PLATE AND LOCKING COMB ASSEMBLY

RELATED APPLICATIONS

This application claims the benefit under 35 U.S.C. § 119(e) of U.S. Provisional Patent Application No. 62/887,946, titled FIREARM STOCK WITH ADJUSTABLE BUTT PLATE AND LOCKING COMB LEVER, and filed on Aug. 16, 2019, the contents of which are incorporated herein by reference in its entirety.

FIELD OF THE DISCLOSURE

The disclosure relates generally to firearms and more particularly to a firearm stock with one or both of an adjustable butt plate and an adjustable comb.

BACKGROUND

Firearm design involves a number of non-trivial challenges, including the design of the firearm stock. The stock is an interface between the shooter and the rifle and transfers recoil from the rifle to the shooter. The stock includes a butt plate constructed to engage the shooter's shoulder and is the primary anchor point of the stock. The stock also has a comb generally configured to engage the shooter's cheek. The shooter uses the butt plate to firmly brace the rifle against the shoulder for stability while aiming. The shooter's cheek contacts the comb while aligning the shooter's eyes with the rifle's sights to obtain a sight picture. A good fitting stock facilitates rapid target acquisition and precise shot placement in addition to enhancing the shooter's ability to hold the rifle still for the shot. Adjustments to a firearm stock includes optimizing the length of pull and comb height to facilitate repeatably positioning the rifle against the body. Such adjustments are available in some stocks, but a number of non-trivial challenges remain.

Figure 1:
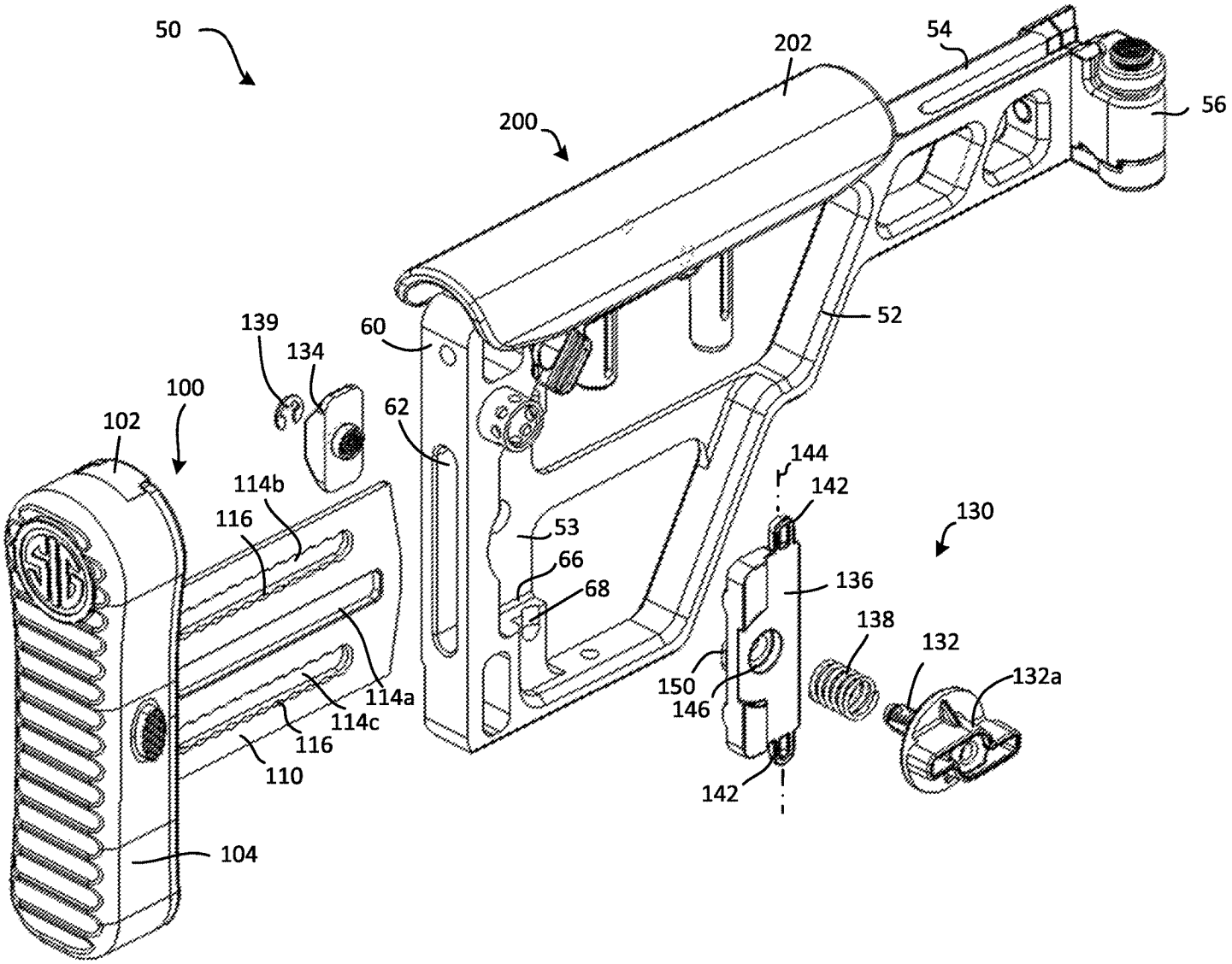
FIG. 1 is an exploded, perspective view showing the rear, right, and top sides of a stock with an adjustable butt plate and adjustable comb, in accordance with an embodiment of the present disclosure.
Figure 2A:
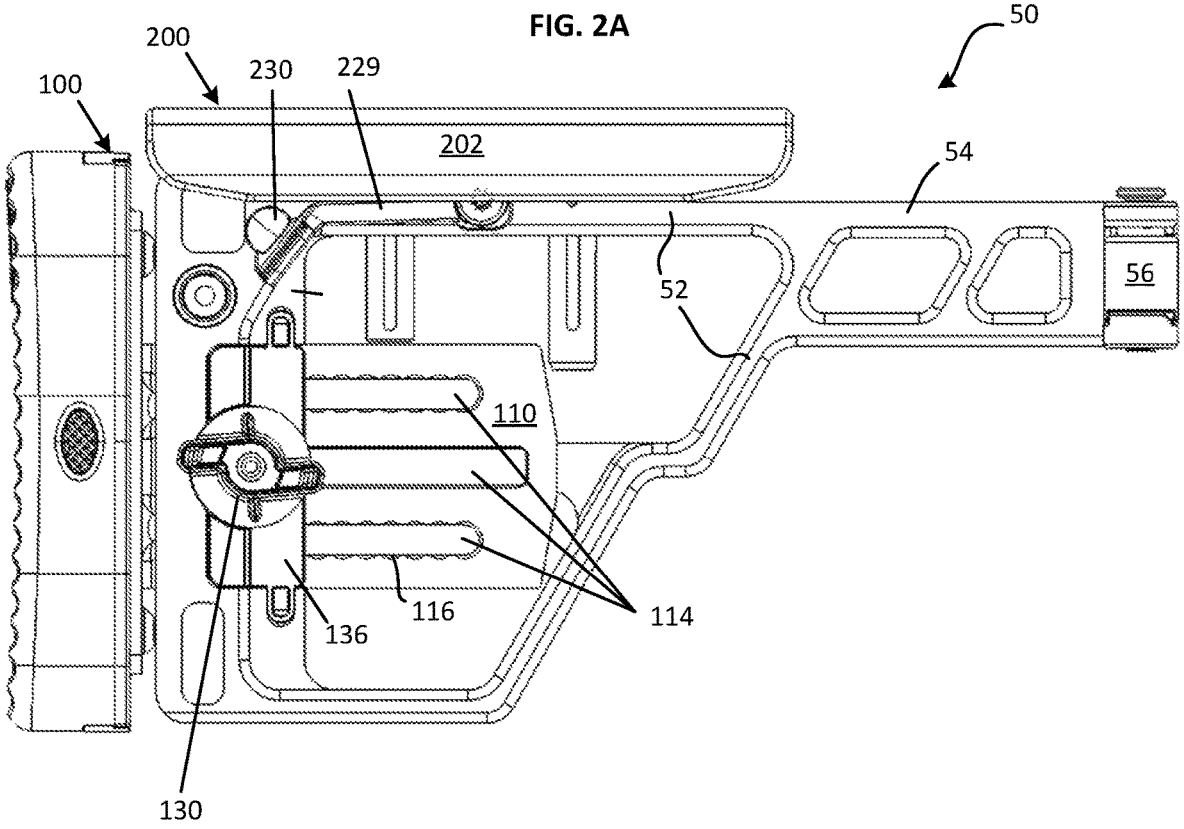
FIG. 2A is a side view showing the right side of an adjustable stock in assembled form with the butt plate in a closed position and comb in a lowered position, in accordance with an embodiment of the present disclosure.
Figure 2B:
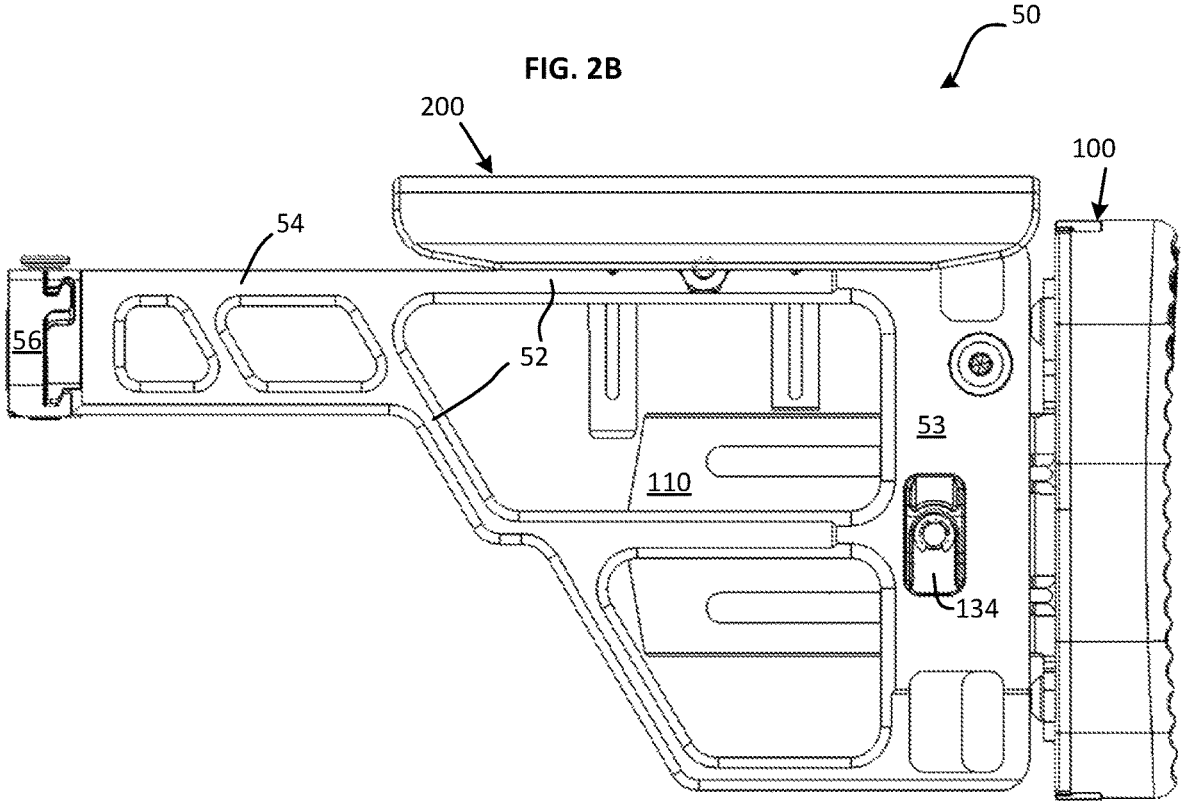
FIG. 2B is a side view showing the left side of the stock of FIG. 2A.

These and other features of the present embodiments will be understood better by reading the following detailed description, taken together with the figures herein described. For purposes of clarity, not every component may be labeled in every drawing. Furthermore, as will be appreciated, the figures are not necessarily drawn to scale or intended to limit the claimed invention to the specific configurations shown.

DETAILED DESCRIPTION

Disclosed is a firearm stock with an adjustable length of pull, an adjustable comb, or both. In one example embodiment including an adjustable comb assembly, a stock body defines post openings extending down into its upper portion. A locking lever is coupled to a fastener that extends laterally through the upper portion of the stock body at a location between the post openings. Moving the lever to the locked position draws the opposite sides of the upper portion of the stock towards one another, thereby constricting the post openings. Accordingly, when posts extending down from a cheek plate or comb are installed in the post openings, moving the lever to the locked position tightly engages the posts to maintain a vertical position of the cheek plate.

The lever can be used to rotate the fastener by an amount from 45-200° between the locked and unlocked positions, in accordance with some embodiments. In some embodiments, the lever has a lever head that engages the fastener head having at least fifteen points. Such an embodiment reduces or eliminates the need for timing the fastener with the position of the lever handle in the locked position. For example, fastener with a 19-point star shape avoids or greatly reduces the need to position the nut and fastener and to select the thread pitch appropriately so that the lever handle rotates to the desired position when the fastener is appropriately tightened.

In another example embodiment, a stock has an adjustable length of pull. In one such embodiment, a butt plate assembly includes a tongue that defines top and bottom chamfered outside edges. A stock body defines corresponding top and bottom chamfered edges along the inside of a slot opening. When the tongue is installed in the slot opening, moving a locking assembly to a locked position draws the chamfered outside edges on the tongue against the chamfered inside edges along the slot opening. A locking plate can be used between the fastener and the tongue to lock the position of the tongue. For example, the locking plate has convex protrusions that engage concave recesses in the tongue. Moving the locking assembly to the locked position draws the locking plate into engagement with the tongue with the protrusions seated in the recesses. In turn, the outside chamfers engage the inside chamfers. In some such embodiments, the butt plate assembly is constrained in six degrees of freedom from translational and rotational movement. Various embodiments of the stock provide a rigid, adjustable butt plate assembly with little or no translational or rotational movement between the components, even in the fully extended position of the butt plate.

The adjustable comb and adjustable length of pull are features that can be provided separately or in combination on a stock. The principles of the stock adjustments disclosed herein also can be applied to other positioning assemblies. Numerous variations and embodiments will be apparent in light of the present disclosure.

General Overview

In competitive shooting sports, hunting, and military situations, precise shooting is highly desirable, and in some cases, critical. In terms of repeatable accuracy, a rifle stock's comb is arguably the most critical component of the stock. When the comb is not placed against the shooter's cheek in exactly the same place for every shot, then replicating the sight picture is difficult and the bullet impact likely will be different from shot to shot. The length of pull is also an important adjustment that can make shooting more comfortable and/or more precise. A length of pull that is too long or too short may cause the user's hand and trigger finger to rotate on the grip, therefore causing the user to push or pull the shot when firing a round. Some existing stocks have an adjustable length of pull and some stocks may also or alternately include an adjustable comb.

The ideal length of pull for each individual user may be determined by, for example, a user's body size, the thickness of clothing being worn, or whether the user is firing from a kneeling, standing, or prone position. Thus, some buttstocks include an extendable butt plate that can be adjusted to change the firearm's length of pull and allow the firearm to be customized for various users and/or firing scenarios. In one example, an adjustable stock has a cylindrical tube attached telescopically on the rifle's buffer tube. The length adjustment is controlled by a release lever on the stock. After depressing the release lever, the user can move the butt plate forward or backward along the buffer tube to change the firearm's length of pull, which is measured by the distance between the trigger and the end of the buttstock.

Another adjustment is the height of the comb or cheek plate of the buttstock. The comb should be adjusted to provide a very firm "cheek weld" to the user. In some scenarios, a properly adjusted comb will cause the user's cheek to "pooch" over the comb while at the same time giving the user a consistent sight picture. A poorly adjusted comb can be uncomfortable in addition to negatively affecting the shooter's performance. In the field, the comb position needed for a firm check weld may change depending on whether the shooter is in a prone, standing, or bench position. Such difference necessitates a quick and reliable adjustment for comb height.

Despite the increased prevalence of adjustable stock assemblies, a number of non-trivial issues remain. For example, existing adjustable stocks use a combination of slip fits or notches for adjusting the position of the butt plate or comb. Another adjustment method utilizes a screw with thumb wheel that can be rotated to advance or retract the butt plate or comb. However, such adjustment methods allow slop and movement in the stock when it is set at the desired position. As noted above, inconsistencies in the position of the stock can result in inconsistent shooting performance. Accordingly, a need exists for improvements to adjustable stocks.

The present disclosure addresses this need and others by providing a rifle stock with improved adjustment assemblies for the position of the butt plate and/or the comb.

Various embodiments of the present disclosure are shown and discussed with reference to a stock body having a skeletonized appearance and including a mounting bracket for attachment to the proximal end of a rifle. Note, however, that the stock subassemblies disclosed herein are not limited to use with this particular stock body. Additionally, adjustment assemblies and rifle stocks as disclosed herein can be used with any suitable host firearm, such as rifles configured for competitive shooting, hunting, or combat, for example. The stock adjustment and locking comb lever may be implemented in various rifles (e.g., Sig Sauer's cross bolt rifle) and various machine/submachine guns (e.g., the Sig Sauer MCX-MR™), to name a few examples. Numerous other configurations and embodiments will be apparent in light of this disclosure.

As discussed herein, terms referencing direction, such as upward, downward, vertical, horizontal, left, right, front, back, etc., are used for convenience to describe embodiments of a stock attached to a firearm and used in a conventional orientation with the barrel extending horizontally. Embodiments of the present disclosure are not limited by these directional references and it is contemplated that a stock and its adjustment assemblies could be used in any orientation.

Also, it should be noted that, while generally referred to herein as a tongue for consistency and ease of understanding the present disclosure, the disclosed tongue is not limited to that specific terminology and alternatively can be referred to, for example, as a length-of-pull arm, a plate, or other terms. Also, while generally referred to herein as a cheek plate for consistency and ease of understanding the present disclosure, the disclosed cheek plate is not limited to that specific terminology and alternatively can be referred to, for example, as a comb, a crest or crown of the stock, a cheek rest, or other terms. As will be further appreciated, the particular configuration (e.g., materials, dimensions, etc.) of a stock or its subassemblies as variously described herein may vary, for example, depending on whether the target application or end-use is military, tactical, or civilian in nature. Numerous configurations and embodiments will be apparent in light of this disclosure.

Example Structures

Figure 3:
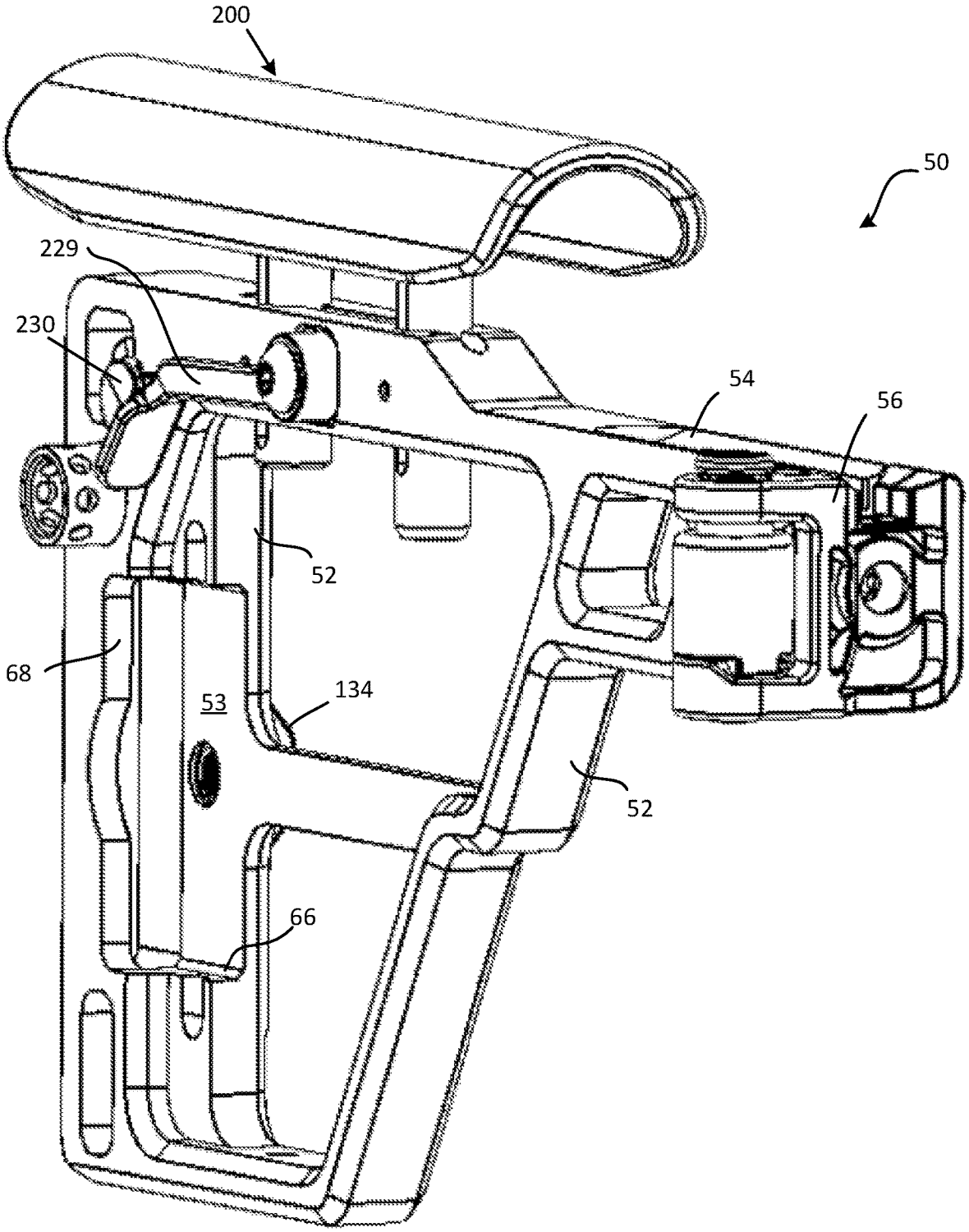
FIG. 3 is a perspective view showing the front, right, and top sides of the stock with the comb in an elevated position and the butt plate removed from the stock body, in accordance with an embodiment of the present disclosure.
Figure 4:
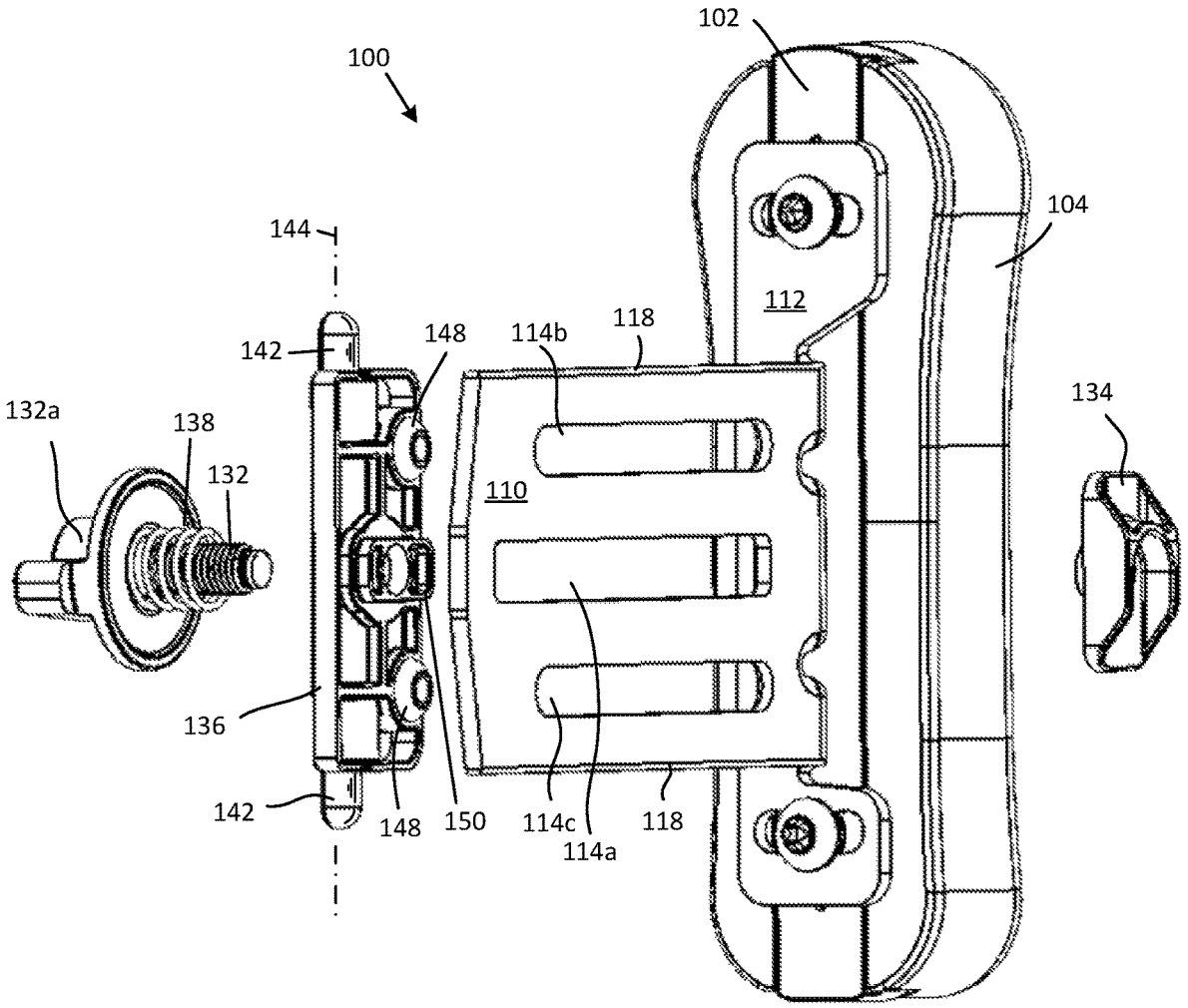
FIG. 4 is a perspective view showing the front and left sides of a butt plate with tongue and components of the locking assembly, in accordance with an embodiment of the present disclosure.
Figure 5:
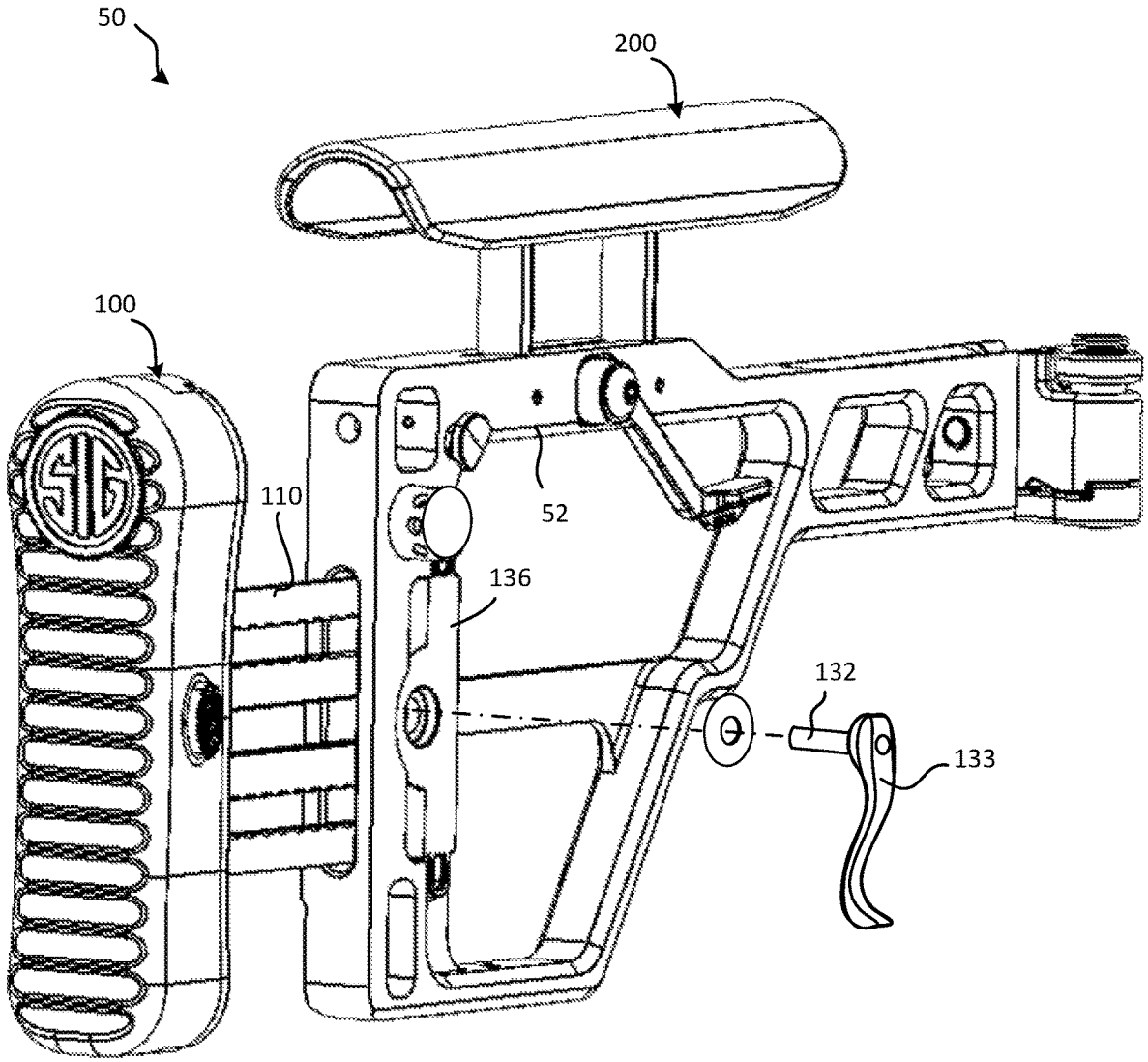
FIG. 5 is a rear perspective view showing an adjustable stock with a locking assembly for the butt plate that utilizes a cam lever, in accordance with an embodiment of the present disclosure.
Figure 6:
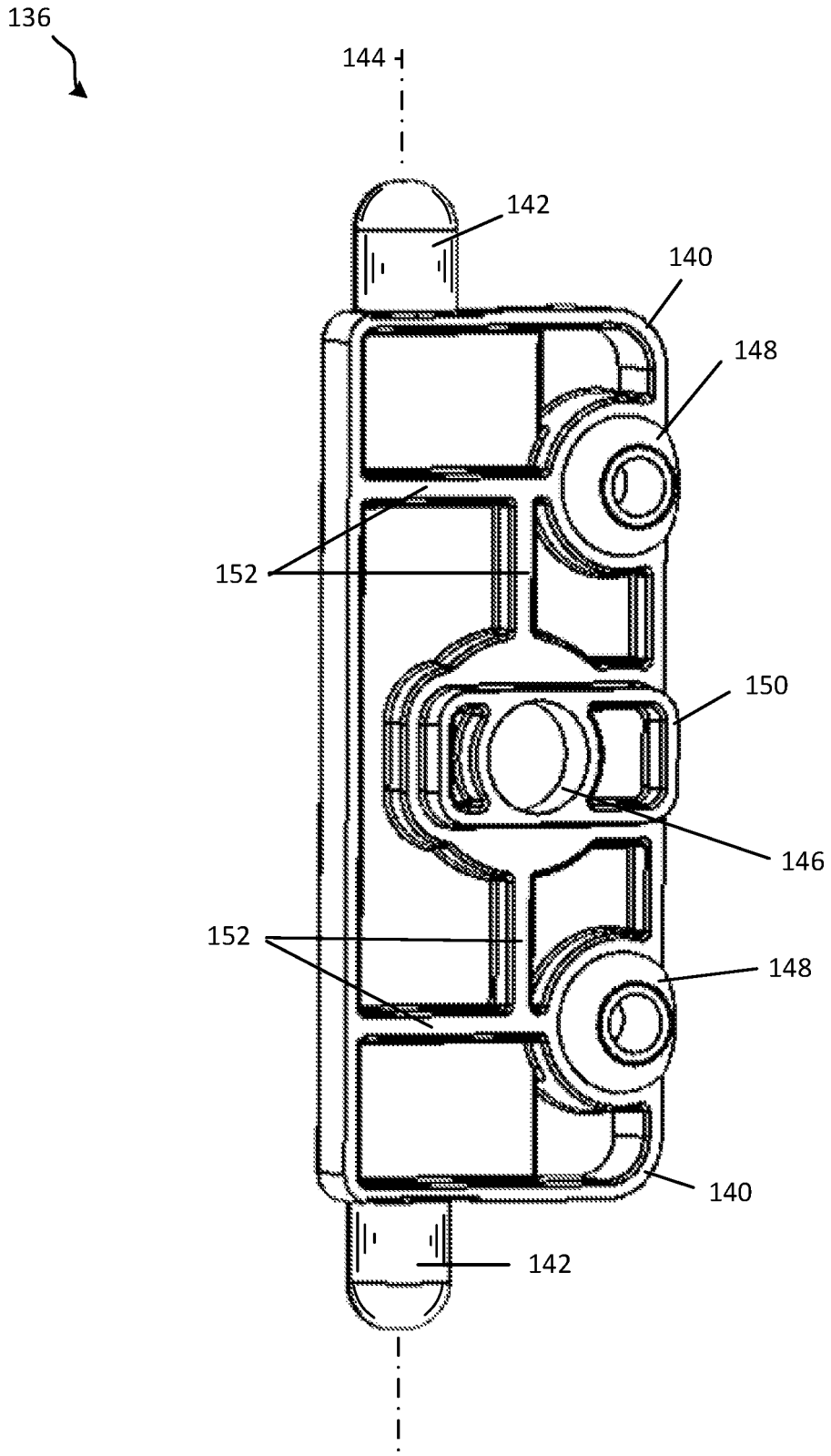
FIG. 6 is a side view of a locking plate, in accordance with an embodiment of the present disclosure.
Figure 7:
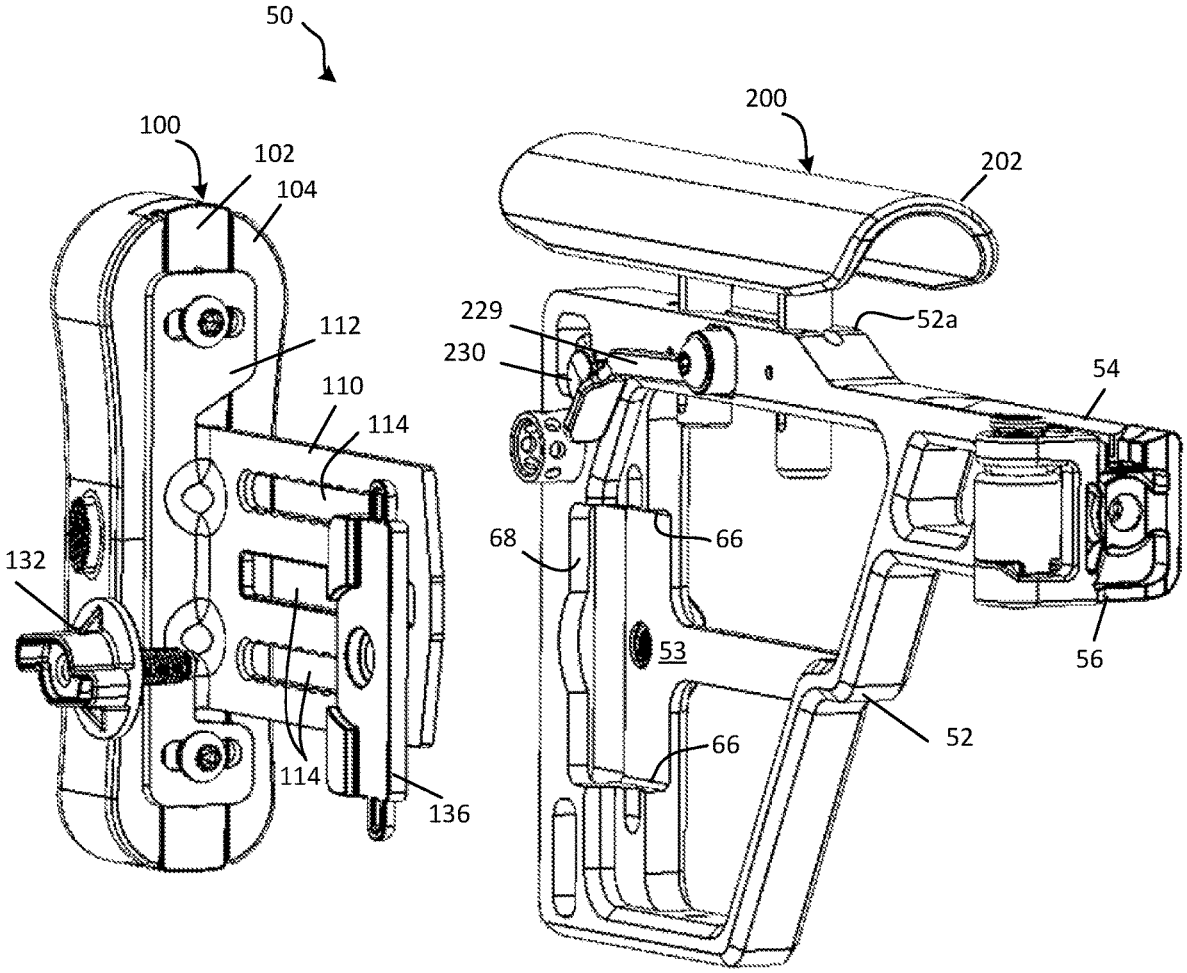
FIG. 7 is a partially exploded, perspective view showing the front, right, and top sides of the stock with the butt plate assembly separated from the stock body, in accordance with an embodiment of the present disclosure.
Figure 8:
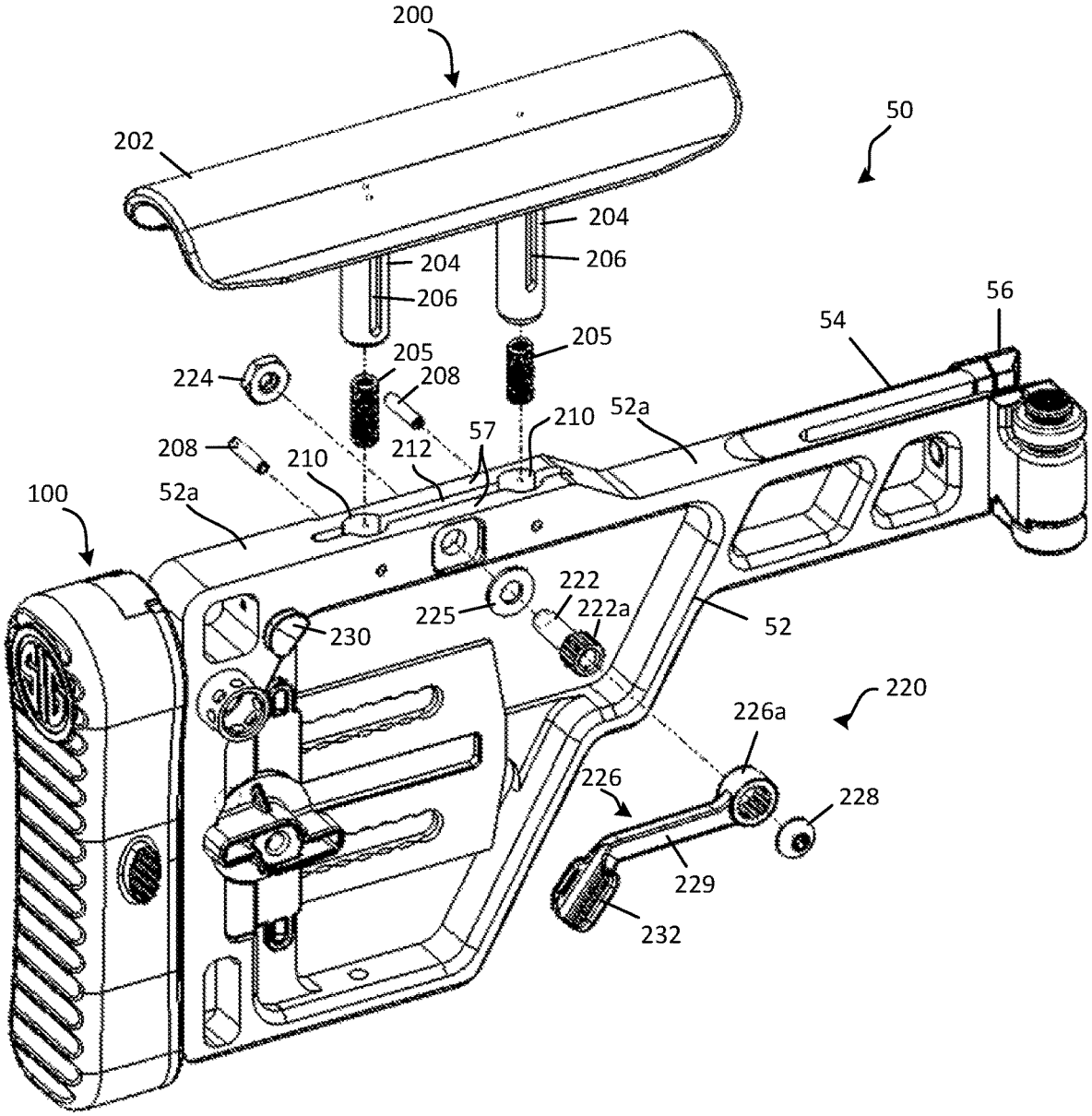
FIGS. 8-9 are partially exploded, perspective views showing the rear, side, and top surfaces of the stock with the butt plate in a closed position and components of the comb assembly separated from the stock body, in accordance with an embodiment of the present disclosure.
Figure 9:
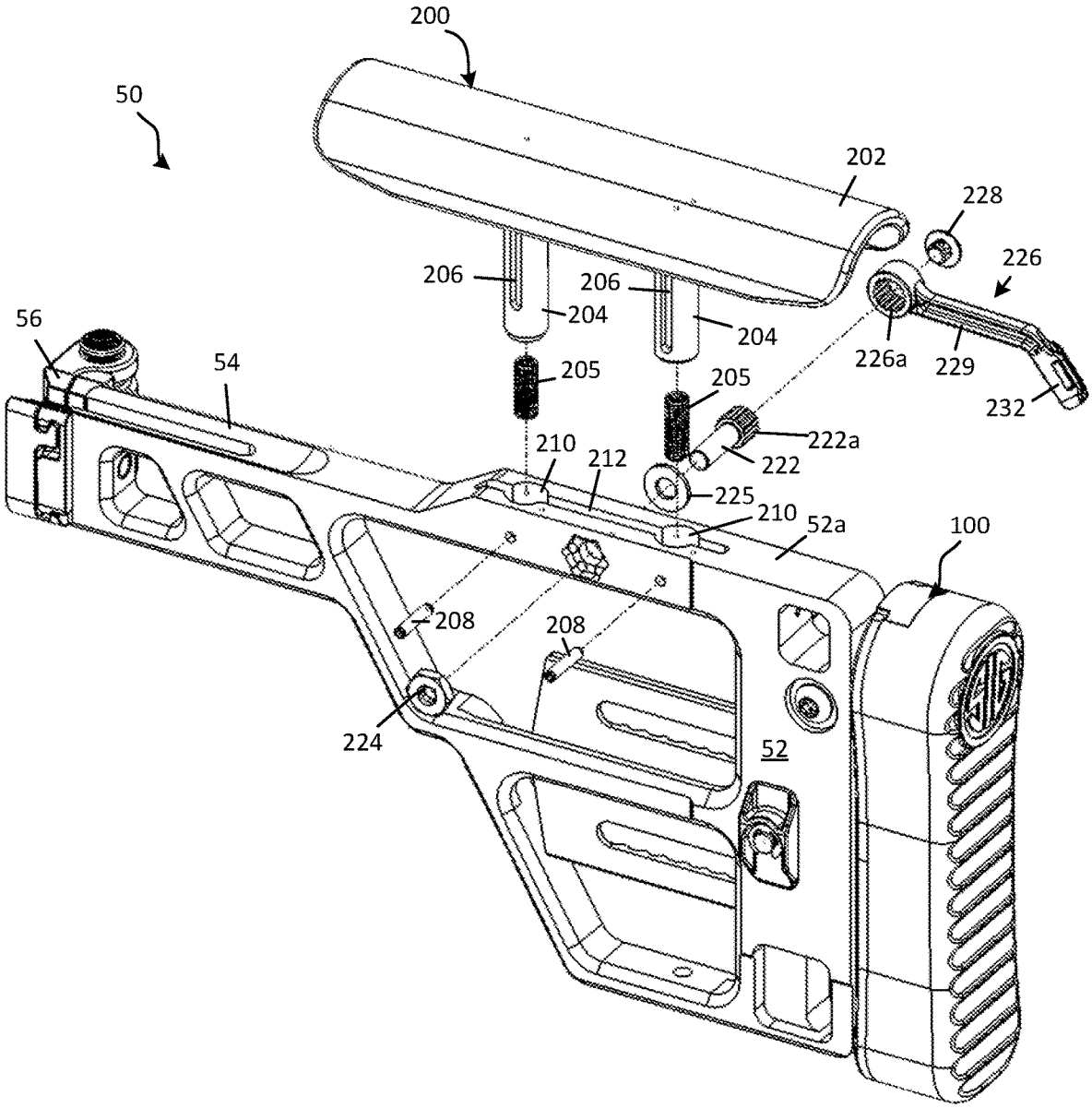
Figure 10:
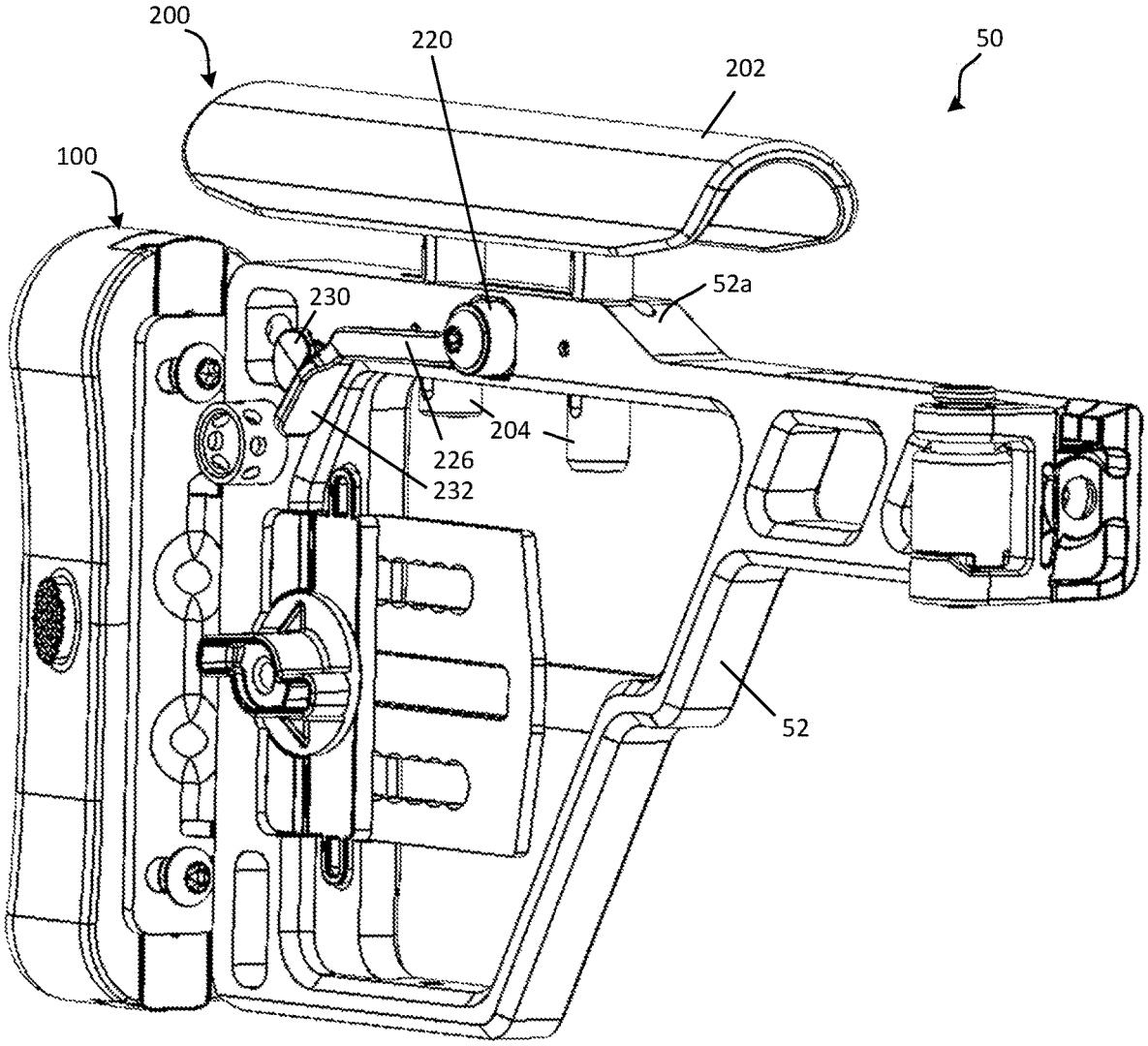
FIG. 10 is a perspective view showing the front, right, and top sides of an adjustable stock with the butt plate in a partially extended position and the comb in a partially elevated position, in accordance with an embodiment of the present disclosure.
Figure 11:
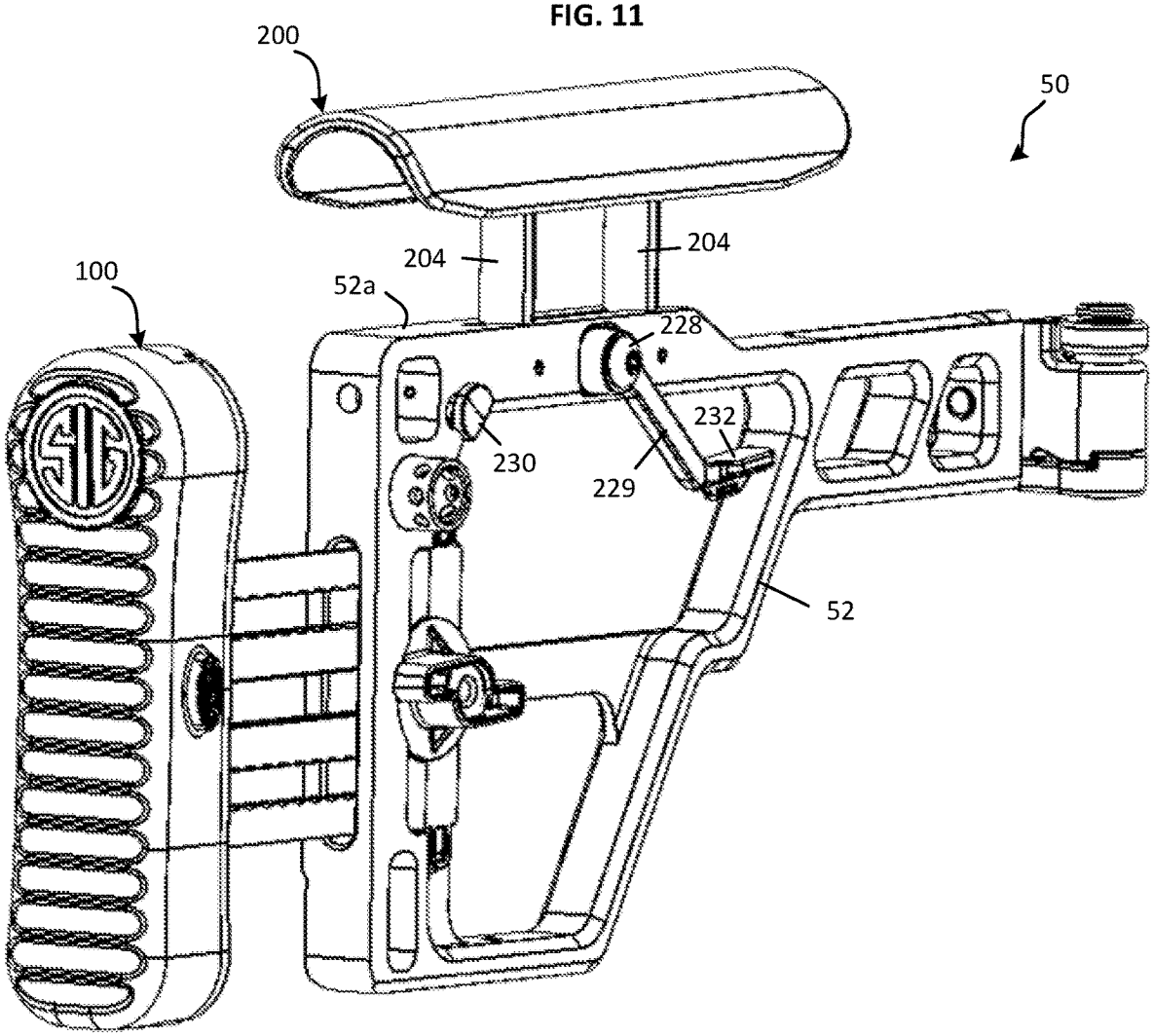
FIG. 11 is a rear perspective view showing the butt plate in a fully extended position, the comb in a fully elevated position, and the locking lever in an unlocked position, in accordance with an embodiment of the present disclosure.
Figure 12:
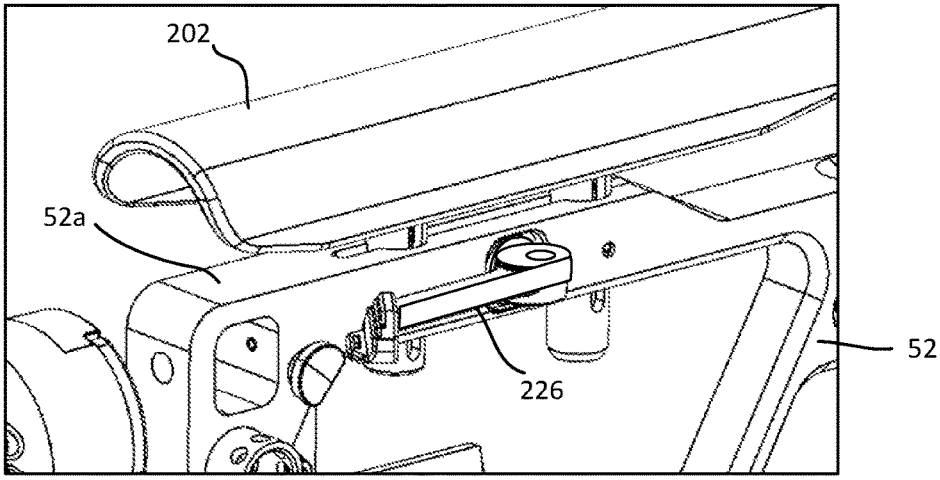
FIG. 12 is a rear perspective view showing part of a comb assembly utilizing a cam lever, in accordance with an embodiment of the present disclosure.

FIGS. 1-12 illustrate various views of a stock 50 with an adjustable butt plate assembly 100 and an adjustable comb assembly 200, in accordance with some embodiments of the present disclosure. FIG. 1 is an exploded, perspective view showing the rear, right, and top sides of the stock 50 and its subassemblies; FIG. 2A shows the right side of the stock 50 in assembled form with the buttstock in a closed position and comb in a lowered position; FIG. 2B shows the left side of the stock 50 of FIG. 2A; FIG. 3 is a perspective view showing the front, right, and top sides of the stock 50 with the comb in an elevated position and the butt plate removed from the stock body; FIG. 4 is a perspective view showing the front and left sides of the butt plate and mounting arm; FIG. 5 is a rear perspective view showing an embodiment of a locking assembly that utilizes a cam lever; FIG. 6 is a side view of a locking plate; FIG. 7 is a partially exploded, perspective view showing the front, right, and top sides of a stock with the butt plate assembly separated from the stock body; FIGS. 8-9 are partially exploded, perspective views showing the rear, left or right, and top sides of a stock 50 with the butt plate in a closed position and components of the comb assembly 200 separated from the stock body 52; FIG. 10 is a perspective view showing the front, right, and top sides of a stock with the butt plate in an extended position and the comb in an intermediate elevated position; FIG. 11 is a rear perspective view showing the butt plate in a fully extended position, the comb in a fully elevated position, and the locking lever in an unlocked position; and FIG. 12 is a rear perspective view showing part of a comb assembly utilizing a cam lever.

Although the figures illustrate the stock 50 equipped with both the adjustable butt plate assembly 100 and the adjustable comb assembly 200, the present disclosure is not limited to such an embodiment. For example, some embodiments of the stock 50 may include only one of these subassemblies. Additionally, in some embodiments, more or fewer components may be included in each assembly, or different versions of some components may be included. For example, the stock 50 may include both an adjustable butt plate assembly 100 and an adjustable comb assembly 200 as variously disclosed herein. In another example, the stock 50 includes an adjustable butt plate assembly 100 with a different comb assembly than disclosed herein, or with a fixed comb. In yet another example, the stock 50 includes an adjustable comb assembly 200 with a different butt plate assembly than disclosed herein, or with a fixed butt plate. In yet another example, some or all of the components of the stock 50 or its subassemblies can be provided as a kit or a group of parts to be assembled. Numerous variations and embodiments will be apparent in light of the present disclosure.

As shown in these examples, the butt plate assembly 100 and comb assembly 200 are assembled or can be assembled with a stock body 52 that includes a support arm 54 that extends distally. A mounting bracket 56 is attached to the distal end of the support arm 54 and is constructed for attachment to a mounting rail, hinge, plate or other feature on the proximal end of a firearm. In some embodiments, the mounting bracket 56 is configured to engage a mounting rail compliant with MIL-STD-1913 (e.g., a "Picatinny" rail or STANAG 2324 rail). In other embodiments, such as shown in FIG. 1, the mounting bracket 56 may include a hinge suitable for folding the stock 50 between a deployed position and a folded position, where one leaf of the hinge is secured to the proximal end of the firearm. The support arm 54 can have any suitable shape, including a rectangular, circular, or other cross-sectional shape, and may be made of metals (e.g., aluminum or its alloys), plastics, composites, or other suitable material or combination of materials. In some embodiments, the stock body 52 and support arm 54 are constructed as a single, monolithic component to which other components can be attached, as will be appreciated. The stock body 52 and/or the support arm 54 can have a solid, skeletonized, hollow, or multi-part structure. In other embodiments, the stock 50 is constructed to be installed on a rifle's buffer tube or similar structure.

The stock body 52 has a proximal end portion 60 defining a receptacle or slot opening 62 that extends axially into the stock body 52. The slot opening 62 is sized and shaped to receive a tongue 110 of an adjustable butt plate assembly 100, embodiments of which are discussed in more detail below. In one embodiment, the proximal end portion 60 of the stock body 52 has a vertical face with a generally rectangular shape. The height of the proximal end portion 60 can be commensurate with that of the butt plate 102, such as from 4-7 inches, or other vertical size. The slot opening 62 defines top and bottom inside chamfers 66 that extend axially into the stock body 52 along a side wall 53. For example, the side wall 53 is part of the stock body 52 and defines a lateral boundary of the slot opening 62. In some embodiments, each inside chamfer 66 is a surface angled at 45° and that extends between the side wall 53 (e.g., vertical wall) and top or bottom walls along the slot opening 62. Other angles for one or both inside chamfers 66 are acceptable, such as 30-60°, 35°, 40°, 50°, and 55° with respect to the horizontal. In some embodiments, the inside chamfers 66 extend in parallel or substantially parallel to each other and define substantially the same angle with the horizontal.

FIGS. 1-2 and 4-7 show components of a butt plate assembly 100, in accordance with some embodiments. In this example, the butt plate assembly 100 includes a butt plate 102 with an optional shoulder pad 104. In one embodiment, the butt plate 102 is a vertical support made of metal or other suitably rigid material. The shoulder pad 104 can be removably or permanently attached to the butt plate 102. For example, the shoulder pad 104 is made of or includes rubber, hard plastic, gel, metal, or other material that provides the desired combination of rigidity, comfort, and performance to the user. In one embodiment, the shoulder pad 104 is removably attached to and slidingly engages the butt plate 102 by way of a mating tongue-and-groove feature. For example, the butt plate 102 defines a T-shaped tongue that can be slidingly received in a T-shaped slot of the shoulder pad 104. In addition, or alternatively, the shoulder pad 104 can be secured to the butt plate 102 with fasteners, adhesive, or a combination of these methods.

The tongue 110 is secured to the distal face of the butt plate 102 and extends axially therefrom. In one embodiment, the tongue 110 includes a bracket 112 oriented substantially at 90° (±5°) and is configured for securing the tongue 110 to the distal face of the butt plate 102. As shown in FIGS. 4 and 5, for example, the bracket 112 is an elongated flat plate with openings for fasteners. In some embodiments, the tongue 110 defines at least one horizontally elongated opening 114 for passage of a fastener therethrough. In the example shown, the tongue 110 includes a central elongated opening 114*a*, a top elongated opening 114*b*, and a bottom elongated opening 114*c*, each of which generally has the shape of a horizontal slot. In some such embodiments, the central elongated opening 114*a* has a uniform vertical dimension along its horizontal length. The top elongated opening 114*b* and bottom elongated opening 114*c* are vertically spaced on the tongue 110 for improved resistance to twisting of the butt plate 102. For example, the top elongated opening 114*b* is spaced about two inches or more from the bottom elongated opening 114*c*. As the distance between the top and bottom elongated openings 114*b*, 114*c* increases, so does the resistance to twisting and torsional forces, as will be appreciated. In other embodiments, the tongue 110 may include one, two, three, or other number of elongated openings 114. The various elongated openings 114 can be evenly distributed vertically on the tongue 110, but such arrangement is not required.

In some embodiments, each of the top and bottom elongated openings 114*b*, 114*c* include a plurality of recesses 116 distributed along the length of the opening for engagement with a protrusion 148 of complementary or mating shape on a locking plate 136, which is discussed below. The recesses 116 can have a frustoconical or concave shape, for example, including hemispherical, partially spherical, elliptical, spheroidal, conical, tetrahedral, or some other suitable shape. In use, the recesses 116 provide a sloped surface against which the corresponding protrusion 148 can be seated, even when the tongue 110 and locking plate 136 are not truly parallel. In some embodiments, the recesses 116 may or may not extend through the tongue 110, and the recesses 116 may or may not overlap an elongated opening or other opening. In one example, the recesses 116 are through openings in the tongue 110, each with a recessed entrance (e.g., hemispherical or frustoconical). The recesses 116 can be spaced along the tongue to overlap so as to define a continuous opening having the shape of an elongated slot with a scalloped upper and lower edges.

In some embodiments, each elongated opening 114 includes two, three, five, eight, ten, or other suitable number of recesses 116, each of which corresponds to an adjustment position of the butt plate 102. For example, the recess 116 positioned most proximally corresponds to a retracted or closed position of the butt plate 102, the recess 166 positioned most distally corresponds to a fully extended or open position of the butt plate 102, and recesses 116 between these end positions provide intermediate positions between the fully open and the fully closed positions.

Referring now to FIG. 4, the top and/or bottom horizontal edges of the tongue 110 define an outside chamfer 118 that is constructed to mate with the inside chamfer 66 in the slot opening 62 in the stock body 52 (shown, e.g., in FIG. 3). For example, both the inside chamfers 66 and outside chamfers 118 are generally planar and define an angle (e.g., 45°) with respect to the horizontal. The inside chamfers 66 and outside chamfers 118 could similarly be mating convex and concave surfaces or some other pair of complementary shapes, in accordance with some embodiments. When the tongue 110 is tightened against the stock body 52, the wedge shape of the chamfers causes the outside chamfers 118 to self-center against the inside chamfers 66. In some such embodiments, when the tongue 110 contacts the stock body 52 along the outside chamfers 118, a gap exists between the principal surface of the tongue 110 and the side wall 53 of the stock body 52. An advantage of such an arrangement is that the pressure at the points of contact is increased (e.g., ball-socket joint of hemispherical recesses/protrusions, and chamfers). Thus, even if dimensional tolerances of the tongue 110 and slot opening 62 are not tight, the gap between the tongue 110 and side wall 53 allows any dimensional slop to be reduced as the chamfers are drawn together in engagement. Accordingly, the tongue 110 can be brought in contact with the stock body 52 with substantially no gaps and substantially no movement.

The tongue 110 is removably secured to the stock body 52 with a fastening assembly 130 that includes a threaded fastener 132, a nut 134, and a locking plate 136, in accordance with some embodiments. In its assembled form, for example, the fastener 132 extends through the locking plate 136, through an elongated opening 114 of the tongue 110, and through the side wall 53 of the stock body 52 to threadably engage the nut 134 located on the opposite side of the side wall 53. As the fastener 132 is advanced into the nut 134 and tightened, the locking plate 136, tongue 110, and stock body 52 are drawn together with points of contact that include the chamfers 66, 118 and recesses 116/protrusions 148. The nut 134 can have any one of a variety of configurations, including a traditional hex nut used with fasteners, and other structures defining a threaded opening.

In some embodiments, the fastener 132 optionally includes a thumb-screw head 132*a* (e.g., a knurled cylinder, T-head, shaped knob, etc.) to facilitate tightening and loosening the fastener 132 by hand. In other embodiments, the fastener 132 includes wrench flats (e.g., a hexagonal or multi-point head), a recess in the head (e.g., a slot, plus, hexagon, or star-shaped recess), or other structure for engagement with a suitable tool. In yet other embodiments, the thumb-screw head 132*a* is attached onto the head of the fastener 132. An optional spring 138 can be disposed between the fastener 132 and the locking plate 136 to bias the threads on the fastener 132 into engagement with threads of the nut 134, inhibiting loosening due to vibration and like forces. The spring 138 can also provide tactile feedback to the user as the fastener 132 rotates through various positions. Optionally, a retaining washer 139 (shown in FIG. 1), such as a c-clip, can be installed on the tip of the fastener 132 to retain the nut 134 in place when the fastener is disengaged from the threads of the nut 134.

In some embodiments, the fastening assembly 130 utilizes a cam lever 133 connected to the fastener 132, such as shown in the rear perspective view of FIG. 5. In some such embodiments, pivoting the cam lever 133 to the locked position (e.g., folded against the stock body 52) draws the locking plate 136 towards the stock body 52, and where pivoting the cam lever 133 to the unlocked position (e.g., folded out to extend away from the stock body 52) allows the locking plate 136 to loosen or partially disengage from the tongue 110. In some such embodiments, the material of the stock body 52 is rigid, yet resilient to facilitate mating the tongue 110 with the stock body 52.

The locking plate 136 includes features that individually or in combination provide a rigid stock 50 and butt plate assembly 100, in accordance with some embodiments. As shown in FIG. 6, for example, the locking plate 136 has a vertically-oriented rectangular shape with rounded corners 140. In addition to its shape and other physical features, the locking plate 136 can be made of metal or other suitably rigid material that reduces bending and flexing to near zero. In some embodiments, for example, the locking plate 136 has beams 152 formed on one or both faces that increase the rigidity of the locking plate 136 while also reducing the weight of the locking plate 136 compared a solid plate of the same overall size and thickness.

Tabs 142 extend from the top and/or bottom ends of the locking plate 136. In some embodiments, the tabs 142 have a semicircular shape. In accordance with one embodiment, the sides, rounded corners 140, and tabs 142 are received in the side wall 53 of the stock body 52, such as where the plate recess 68 defines a corresponding rectangular shape with rounded corners and semicircular tab slots. In some embodiments, the locking plate 136 further defines protrusions 148 corresponding in position to recesses 116 on the tongue 110. As noted above, the protrusions can be hemispherical, partially spherical, convex, elliptical, spheroidal, frustoconical, tetrahedral, or have some other suitable shape that mates with or otherwise engages the recesses 116 on the tongue 110, in accordance with some embodiments. For example, the protrusions 148 and recesses 116 have a hemispherical shape that defines a ball-and-socket joint. In one such embodiment, the locking plate 136 has upper and lower hemispherical protrusions 148 that can engage hemispherical recesses 116 in the top elongated opening 114*b* and bottom elongated opening 114*c* when the fastener 132 is tightened. In another example, the locking plate 136 has one or more protrusion 148 aligned axially with the fastener opening 146 to engage recesses 116 on an elongated opening 114 in the tongue 110 (e.g., central elongated opening 114*a*).

In some embodiments, the locking plate 136 further defines a guide protrusion 150, such a guide protrusion 150 having a generally rectangular shape or functionally equivalent structure. For example, the guide protrusion 150 is generally rectangular with a horizontal orientation and surrounds or includes the fastener opening 146, where the guide protrusion 150 is sized to be received in the elongated opening 114 in the tongue 110 (e.g., central elongated opening 114*a*). When the guide protrusion 150 is sized to have a close fit with the central elongated opening 114*a*, for example, the guide protrusion 150 engages or is constrained between the upper and lower surfaces of the elongated opening 114 to limit rotation and vertical translation of the locking plate 136 relative to the tongue 110. Tighter tolerances in the fit between the guide protrusion 150 and elongated opening 114 and/or an increased horizontal length of the guide protrusion 150 further confine and limit the available movement between these components, as will be appreciated. In other embodiments, the guide protrusion 150 is approximated by upper and lower horizontal shelves or the like that are constrained between the respective top and bottom surfaces of the elongated opening 114.

Points of contact between the locking plate 136, tongue 110, and stock body 52 function individually and in combination to reduce or eliminate movement in the butt plate assembly 100 when the locking assembly 220 is tightened, thereby providing stock 50 that is quite rigid and featuring an adjustable butt plate 102. For example, combined features of the locking plate 136, tongue 110, and stock body 52 provide redundant constraints that eliminate movement between the stock body 52 and the butt plate 102. As a result, when the fastening assembly 130 is engaged and tightened, and rigid materials are used (e.g., metals) the butt plate assembly 100 is very rigid with little or no movement between components even in its most extended position.

When the fastening assembly 130 is tightened, the tongue 110 is over-constrained to greatly reduce or eliminate movement. In one aspect, the outside chamfers 118 on the tongue 110 are drawn against the inside chamfers 66 in the slot opening 62 such that a gap exists between the principal surface of the tongue 110 and the side wall 53 of the stock body 52. The wedge formed between the chamfers and the self-centering action of the chamfers results in a rigid attachment that substantially eliminates movement, including tilting (e.g., rotation of the stock body 52 right or left with respect to the support arm 54) and lateral movement (e.g., butt plate 102 shifting right or left with respect to the stock body 52). The wedge fit formed by the complementary chamfers also prevents relative vertical movement between these components. Frictional engagement between the chamfers inhibits axial (horizontal) translation between these components. Combined with the mating surfaces of the protrusions 148 and recesses 116 (e.g., a ball-and-socket joint), axial movement is substantially eliminated when the fastening assembly 130 is tightened.

Further, when the locking plate 136 engages the tongue 110, the guide protrusion 150 is received in the slot-shaped elongated opening 114 in the tongue 110 and the protrusions 148 engage recesses 116 in the top and bottom elongated openings 114*b*, 114*c*. Since the tabs 142 are offset from the fastener opening 146 in the locking plate 136, the tabs 142 define a vertical axis of rotation 144 about which the locking plate 136 can pivot. When the fastener 132 is tightened, the locking plate 136 pivots to draw the protrusions 148 into the recesses 116 in the tongue 110 and also draw the outside chamfers 118 against the inside chamfers 66. The at least three nonlinear points of contact reduce or eliminate movement between these components, including vertical rotation along the median plane, rotation of the buttstock about a longitudinal axis, translational movement between the components (e.g., horizontal and vertical sliding), and pivoting (e.g., tongue 110 being moved laterally with respect to the stock body 52).

Further, the rectangular shape of the locking plate and the tabs 142 on the locking plate 136 define at least three nonlinear points of contact with the stock body 52 to prevent rotation of the locking plate 136 within the plate recess 68. When the locking plate 136 engages the tongue 110, it also prevents the butt plate 102 from rotating. The multiple points of engagement between the locking plate 136 and the stock body 52, and between the locking plate and the tongue 110, also substantially eliminate horizontal and vertical translation between these components. The combined result is an easily adjusted and exceptionally rigid butt plate assembly 100 that has little or no movement when tightened, in accordance with some embodiments.

Referring now to FIGS. 8-12, a stock 50 with adjustable comb assembly 200 is illustrated in accordance with an embodiment of the present disclosure. FIGS. 8 and 9 illustrate partially exploded views of the stock 50 and comb assembly 200, showing the top, right or left, and rear sides. FIG. 10 illustrates a front and side perspective view showing the comb assembly 200 assembled with the stock 50, where the cheek plate 202 is adjusted to an intermediate height setting above the stock body 52 and the lever 226 in a locked position. FIG. 11 illustrates a rear perspective view showing the comb assembly 200 with the cheek plate 202 adjusted to an elevated height and with the lever 226 in an unlocked position. FIG. 12 illustrates a rear perspective view showing part of the comb assembly 200 in which the lever 226 is configured as a cam lever. Note that additional views of a comb assembly 200 are shown in FIGS. 1-3, 5, and 7, in accordance with some embodiments of the present disclosure.

In accordance with one embodiment, the cheek plate 202 has a convex shape that extends longitudinally along the top portion 52*a* of the stock body 52. Such shape can provide a comfortable fit with the soft tissue of a user's cheek. For example, the cheek plate 202 follows a generally cylindrical profile. In other embodiments, the cheek plate 202 can be solid, can have a rectangular profile with rounded corners, or have an asymmetrical profile, for example. The particular shape of the cheek plate 202 can be any of a variety of shapes and configurations suitable to engage the user's cheek, as will be appreciated.

One or more posts 204 extend down from the cheek plate 202. In the example shown, the cheek plate 202 includes two posts 204, but a single post or more posts 204 can be used. Each post 204 is sized and constructed to be slidably received in a post opening 210 defined through the top portion 52*a* of the stock body 52. In this example, the posts 204 are illustrated as having different vertical lengths, but this is not required; in other embodiments, each post 204 has the same length. In one embodiment, the posts 204 have centers spaced about 1-3", including as about 1", 1.5", 2", 2.5", or 3". Other spacings may be used depending on the materials used for the stock body 52, desired clamping force, and other factors, as will be appreciated.

Optionally, at least one post 204 defines a flat in an outside surface of the post 204, a through-slot 206, or other feature for engagement with a fastener or pin 208 that inhibits removal of the cheek plate 202 from the stock body 52. In this example, each post 204 has a through-slot 206. In its installed condition, a retaining pin 208 extends through the stock body 52 and through the through-slot 206. In other embodiments, a set screw engaging the post 204, flange or screw-on cap on the bottom of the post 204, or other feature may be used to limit the upward extension of the cheek plate 202 above the stock body 52 and to inhibit inadvertent removal of the cheek plate 202 from the stock body 52.

The post openings 210 are connected by a longitudinal slit opening 212 that extends vertically through the top portion 52*a* of the stock body 52. When the top portion 52*a* is configured as a beam or the like with a hollow region below it, the slit opening 212 allows opposite lateral sides 57 of the top portion 52*a* to be drawn inward towards one another to engage the posts 204 with a pinching or clamping action and hold the position of the cheek plate 202. In one example, a locking screw 222 extends laterally through the top portion 52*a* of the stock body 52 between the post openings 210 and engages a nut 224 or equivalent on the opposite side of the top portion 52*a*. As the locking screw 222 is tightened, the top portion 52*a* of the stock body 52 is temporarily deformed so that the post openings 210 are constricted, causing the stock body 52 to tightly engage the posts 204 and lock the position of the cheek plate 202. In some embodiments, the stock body 52 is made of aluminum, steel, carbon fiber, plastic, other metal or alloy, a polymer composite, or other rigid material so long as the material is sufficiently resilient to be deformed by tightening the locking screw 222 and then return upon loosening the locking screw 222 to the non-deformed shape it had prior to tightening the locking screw 222.

In some embodiments, each post 204 is hollow and houses a spring 205 disposed between the cheek plate 202 and the pin 208. In some embodiments, the spring 205 is compressed and biases the cheek plate 202 towards an elevated position. For example, the spring bias is sufficient to move the cheek plate 202 upward against the force of gravity and against friction of the post opening 210 when the locking assembly 220 is in an unlocked condition. In other embodiments, the spring 205 is expanded and applies a downward force on the cheek plate 202 to bias the cheek plate 202 towards a low or intermediate position. Placing a spring 205 in each post 204 may also help the posts 204 avoid binding in the post openings 210, such as when the springs apply an approximately equal bias force on each post 204. Further, each spring 205 can be used to apply a force to the pin 208 so that the pin 208 resists coming out of the pin opening due to vibration, recoil forces, or the like.

In one embodiment, the locking screw 222 is part of a locking assembly 220 that also includes a nut 224 and a handle or lever 226. For example, the locking screw 222 has a screw head 222*a* that is multifaceted, such as a 19-point star or the like. The lever 226 has a lever head 226*a* constructed to mate with and engage the screw head 222*a*, such as a round head with inner surface defining facets corresponding points of the screw head 222*a*. Other locking screws 222 can be used, including a hex-head bolt or a machine screw with a hex or star recess, for example. An advantage of having many facets or points on the screw head 222*a* is that it eliminates or reduces the need for timing the locking screw 222 so that the lever 226 occupies the desired rotational position when in the locked and unlocked positions. For example, the lever handle 229 extends horizontally rearward when the locking assembly 220 is in the locked condition, and the lever handle 229 rotates to an unlocked condition from 30° to 180° (or more) in which the post openings 210 allow sliding movement of the posts 204 in the post openings 210. The user can use the multi-faceted screw head to adjust the amount of engagement in a locked condition to hold the cheek plate 202 in the desired position, while also having the lever handle 229 oriented horizontally in the desired condition. For example, the lever 226 can be removed from the locking screw 222, rotated slightly, then reassembled to the locking screw 222.

The amount of rotation for the locking screw 222 between the locked condition and the unlocked condition depends on several factors that include the fit between the post 204 and post opening 210, the coarseness of the locking screw 222, the spacing of the posts 204, the dimensions of the slit opening 212, and the desired amount of frictional force on the posts 204 when the locking assembly 220 is in the locked condition. In some embodiments, the unlocked condition begins when the lever 226 is rotated from the locked condition by 30°, 45°, 60°, 75°, 90°, 105°, 120°, 135°, 150°, 180°, 200°, or some other amount. In some embodiments, the locked position of the lever 226 is identified when the lever 226 is rotated into contact with or near contact with a stop block 230 or equivalent on the stock body 52. As shown in FIGS. 2A, 3, 7, and 10, for example, the lever 226 is in a locked position in which the lever handle 229 extends substantially horizontally and a grip 232 on the lever 226 abuts or nearly abuts the stop block 230. In this example, the grip 232 is angled at 45° to the lever handle 229. As shown in FIG. 11, for example, the lever 226 is in an unlocked position in which the lever handle 229 has been rotated about 135° counterclockwise from the locked position shown in FIG. 10. As will be appreciated, once the lever 226 reaches the unlocked condition, further rotating the lever 226 counterclockwise (as viewed looking at the right side of the stock 50) will continue to loosen the locking screw 222, but further loosening rotation may have little or no additional change on the frictional engagement between the stock body 52 and the posts 204.

In other embodiments, the post openings 210 are sized to engage the posts 204 in a resting state with sufficient force to prevent adjustment of the cheek plate 202 position. In some such embodiments, the locking assembly 220 is configured so that rotating the locking screw 222 to the unlocked position further separates the opposite sides of the top portion 52*a* of the stock body 52 along the slit opening 212 so as to slightly enlarge the post openings 210 and disengage from the posts 204. For example, one side of the top portion 52*a* has a threaded opening for the locking screw 222. When the screw extends through the threaded opening and contacts the opposite side of the top portion 52*a*, the screw can be advanced when moving the locking screw 222 to the unlocked position so that the screw pushes against the opposite side of the top portion 52*a* to temporarily deform the material.

In yet another embodiment, the locking assembly 220 utilizes a cam lever connected to the locking screw 222, such as illustrated in FIG. 12. In some such embodiments, moving the cam lever to the locked position (e.g., folded against the stock 50) draws together the opposite sides of the top portion 52*a* of the stock body 52, and where moving the cam lever to the unlocked position (e.g., folded out to extend away from the stock 50) allows the opposites of the top portion 52*a* to return to the undeformed state. A cam lever can similarly be used to deform the top portion 52*a* of the stock body 52 to further separate the opposite sides of the top portion 52*a* when moving the cam lever to an unlocked position, and in the locked position allow the top portion 52*a* to return to an undeformed shape in which the posts 204 are firmly engaged.

In some embodiments, the nut 224 and/or the screw head 222*a* (shown in FIG. 9) can be recessed into the stock body 52. In some embodiments, the nut 224 is omitted and instead the locking screw 222 engages a threaded opening in the opposite side of the stock body 52. Optionally, a washer 225 can be used between the screw head 222*a* and the stock body 52 and/or between the nut 224 and the stock body 52 to distribute forces.

In some embodiments, the lever 226 can be attached to the locking screw 222 by placing the lever head 226*a* on the screw head 222*a* at the time of making adjustments to the cheek plate 202. In other embodiments, the lever 226 is semi-permanently attached to the locking screw 222, such as with a machine screw passing through the lever head 226*a* and into a threaded recess in the screw head 222*a* of the locking screw 222. In yet other embodiments, the lever 226 is permanently attached to the locking screw 222 by welding or being formed as a single piece with the locking screw 222.

Figure 13:
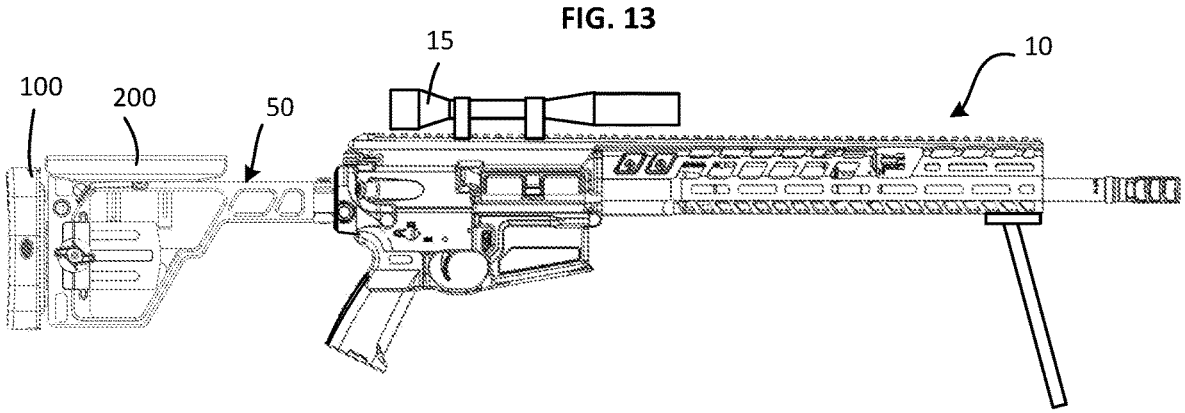
FIG. 13 is a side view of a rifle with an adjustable stock, in accordance with an embodiment of the present invention.

FIG. 13 illustrates a side view of an example rifle 10 equipped with a stock 50 that includes an adjustable butt plate assembly 100 and an adjustable comb assembly 200, in accordance with an embodiment. The rifle 10 includes a scope 15 mounted along the top of the rifle's receiver. In this example, the rifle 10 is configured for long-distance shooting, such as targets at 500 yards or more. Numerous variations and embodiments will be apparent in light of the present disclosure.

Although discussed in the context of a rifle stock, components and principles of operation of the butt plate assembly 100 and the comb assembly 200 are not limited to use with a stock 50 for a firearm. Such adjustment assemblies can be used in other fields, such as adjustable arm rests, equipment positioning, and other objects of adjustable height or length.

Figure 14:
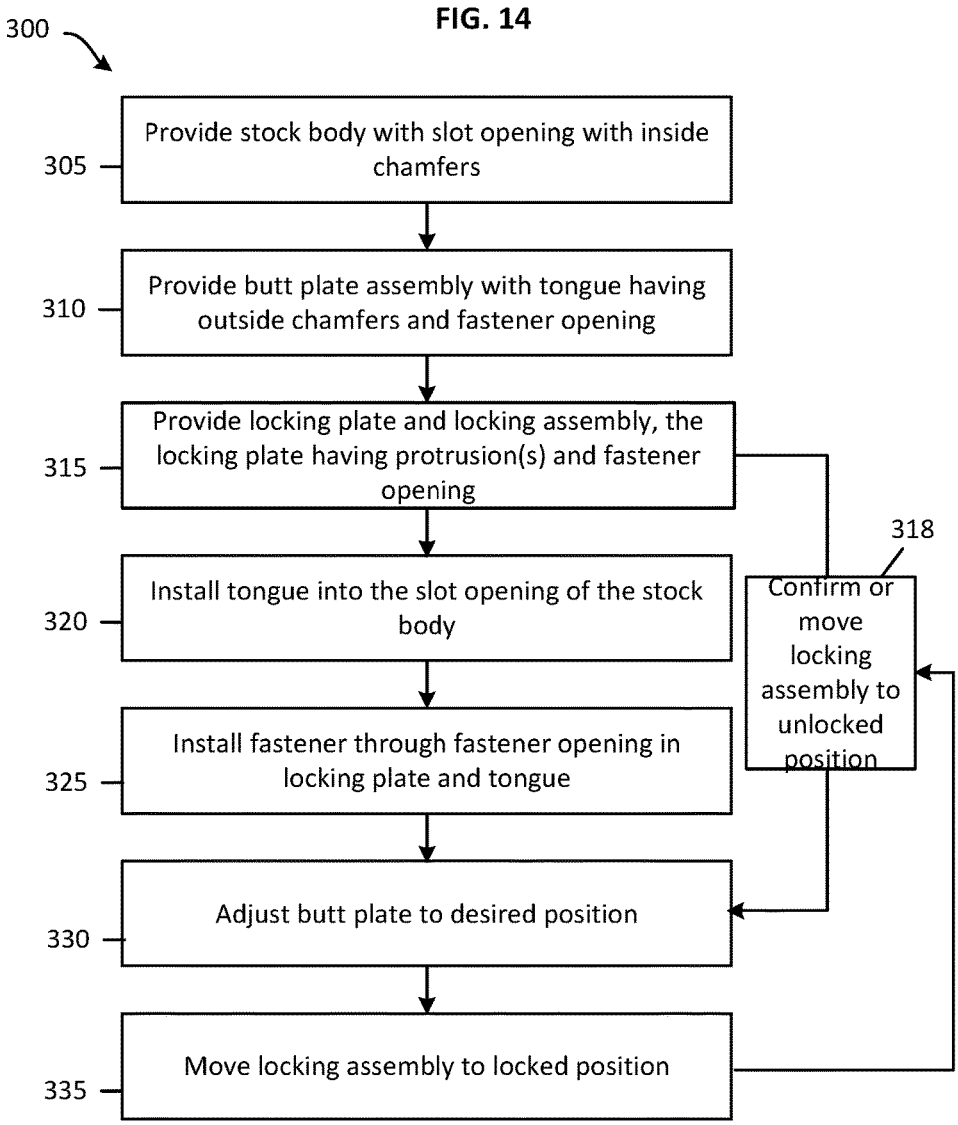
FIG. 14 is a flow diagram for a method of adjusting the length of pull for a rifle stock, in accordance with an embodiment of the present disclosure.

Referring now to FIG. 14, a flow chart illustrates a method 300 of adjusting the length of pull for a rifle stock, in accordance with an embodiment of the present disclosure. Method 300 begins with providing 305 a stock body having a slot opening with inside chamfers, providing 310 a butt plate assembly with a tongue that has outside chamfers and a fastener opening, and providing a locking plate and locking assembly. Examples of the stock body, butt plate assembly, locking plate, and locking assembly are discussed above.

In some embodiments, the stock is provided in an assembled state with the tongue installed in the slot opening of the stock body and a fastener of the locking assembly installed through the locking plate and tongue to engage a nut or the like on the opposite side of the stock body. In such embodiments, method 300 continues with adjusting 330 the butt plate to the desired position. If the locking assembly is in the locked position, adjusting 330 the butt plate begins with moving 318 the locking assembly to the unlocked position. In the unlocked position, the locking plate disengages from the tongue to allow movement of the tongue in the slot opening. The outside and inside chamfers also disengage or partially disengage. To change the length of pull, the butt plate is moved towards or away from the proximal end of the stock body by sliding the tongue into or out from the slot opening. Movement of the tongue may be guided by the chamfers as well as by the fastener extending through the fastener opening, which is an elongated slot in some embodiments. In other embodiments, the tongue defines a plurality of distinct fastener openings each corresponding to a particular length of pull. In such embodiments, the fastener may be removed from the tongue, the tongue position adjusted, and then the fastener replaced through another of the fastener openings.

After the butt plate is in the desired position, the locking assembly is moved 335 to the locked position. In the locked position, the protrusions on the locking plate are drawn against the tongue to draw the outside chamfers against the inside chamfers. This action binds the assembly to provide a rigid stock and butt plate with little or no movement.

In other embodiments, the stock is provided in a disassembled state or partially assembled state. In some such embodiments, method 300 continues with inserting the tongue of the butt plate assembly into the slot opening of the stock body, placing the locking plate against the tongue, and installing a fastener of the locking assembly through the fastener openings in the locking plate and tongue. The fastener is then advanced to engage a nut or functionally equivalent structure on the opposite side of the stock body. The locking assembly is then moved to the locked position, such as by further advancing the fastener, or by moving a lever connected to the fastener, for example.

For subsequent changes to the length of pull, method 300 repeats moving 318 the locking assembly to the unlocked position, adjusting 330 the butt plate to the desired position, and moving 335 the locking assembly to the locked position.

Figure 15:
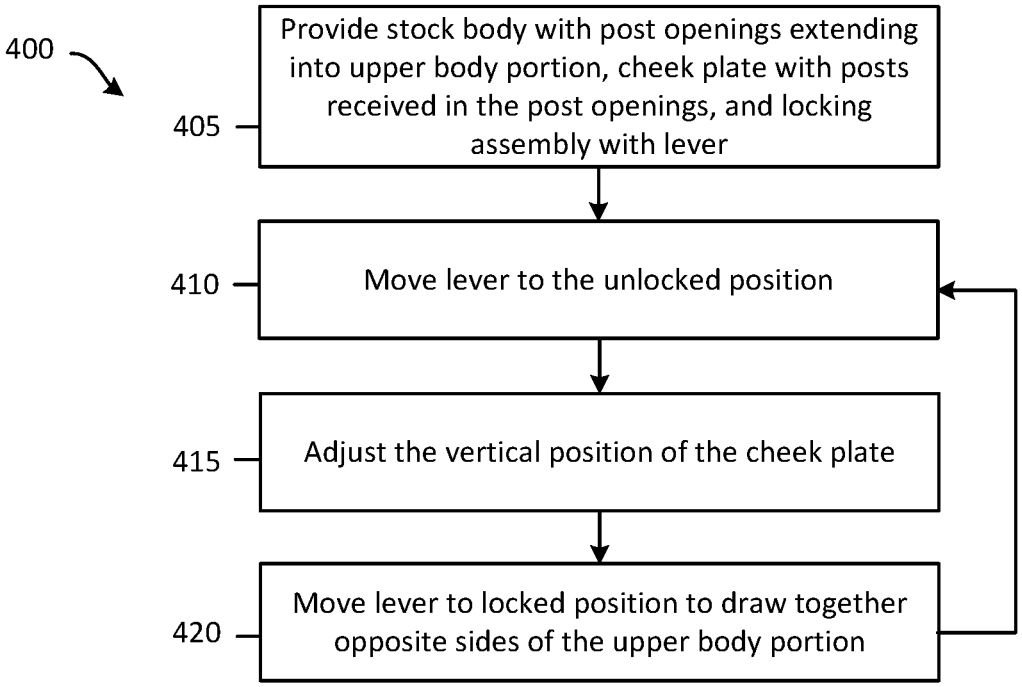
FIG. 15 is a flow diagram for a method of adjusting the comb height of a rifle stock, in accordance with an embodiment of the present disclosure.

Referring now to FIG. 15, a flow chart illustrates a method 400 of adjusting the length of pull for a rifle stock, in accordance with an embodiment of the present disclosure. Method 400 begins with providing a stock body with post openings extending into an upper body portion, the upper body portion also defining a slit opening extending between and connecting the post openings; providing a cheek plate with posts received in the post openings; and providing a locking assembly with a fastener and a lever, where the fastener extends crosswise through the upper body portion between the post openings. Example embodiments of these assemblies are discussed above.

Method 400 continues with moving 410 the locking assembly lever to an unlocked position. For example, the lever is connected to a fastener that extends laterally through the upper body portion. By rotating the lever, and therefore loosening the fastener, pressure on the post openings is reduced and the frictional engagement with the posts is reduced or released.

Method 400 continues with adjusting 415 the vertical position of the cheek plate. For example, the cheek plate is pushed up or down so that the posts slide partially out of or further into the post openings.

Method 400 continues with moving 420 the lever to the locked position to draw together opposite sides of the upper body portion to constrict the post openings. In the locked position, the post openings frictionally engage the posts to retain the position of the cheek plate.

The flow charts for method 300 and method 400 illustrate example embodiments and are presented in a particular order for convenience in describing the various actions. However, the actions of methods 300 and 400 are not necessarily required to be performed in the order disclosed unless specifically stated. Additionally, some actions may be optional and not performed at all. Further, additional actions not specifically disclosed may be included as part of a particular action, as will be appreciated. Numerous variations and embodiments will be apparent in light of the present disclosure.

Further Example Embodiments

The following examples pertain to further embodiments, from which numerous permutations and configurations will be apparent.

Example 1 is a firearm stock with an adjustable length of pull, the stock comprising a tongue having a longitudinal planar shape with top and bottom chamfered outside edges; a stock body defining a slot opening extending into the body through a proximal end of the body, the slot opening sized to receive the tongue and having top and bottom chamfered inside edges along the slot opening corresponding to the chamfered outside edges on the tongue; and a locking assembly operable between a locked position and an unlocked position, wherein in the locked position with the tongue received in the slot opening, moving the locking assembly to the locked position draws together the chamfered outside edges on the tongue and the chamfered inside edges along the slot opening.

Example 2 includes the subject matter of Example 1, wherein the tongue defines a longitudinal opening extending generally parallel to the chamfered outside edges; wherein the locking assembly includes a threaded fastener and a nut; and wherein in an assembled state with the tongue received in the slot opening, the threaded fastener extends through the longitudinal opening in the tongue, through the stock body, and into the nut on a first side of the stock body.

Example 3 includes the subject matter of Example 2 and further comprises a locking plate with at least one protrusion and a fastener opening; wherein the stock is in the assembled state, the locking plate is positioned on an opposite second side of the stock body with the tongue between the stock body and the locking plate, a portion of the locking plate in contact with the stock body, and the threaded fastener extending through the fastener opening in the locking plate; and wherein moving the locking assembly to the locked position draws the at least one protrusion on the locking plate into engagement with the tongue.

Example 4 includes the subject matter of any of Examples 1-3, wherein the portion of the locking plate in contact with the body includes a first tab extending from an upper end of the locking plate and a second tab extending from a lower end of the locking plate, the first tab and the second tab linearly aligned along a tab axis; and wherein the body defines a first tab recess and a second tab recess, the first tab received in the first tab recess and the second tab received in the second tab recess when the clamping assembly is in the assembled state such that the locking plate can pivot about the tab axis.

Example 5 includes the subject matter of Example 3, wherein the at least one protrusion has a convex shape and the tongue defines a plurality of concave recesses along the longitudinal opening, the concave recesses sized and configured to mate with the convex shape of the at least one protrusion.

Example 6 includes the subject matter of Example 5, wherein the plurality of concave recesses includes a first plurality of concave recesses above and linearly aligned along the longitudinal opening and a second plurality of concave recesses below and linearly aligned along the longitudinal opening; wherein the at least one protrusion on the locking plate includes a first protrusion and a second protrusion, wherein the first protrusion is positioned to engage one of the first plurality of concave recesses and a second protrusion is positioned to engage one of the second plurality of concave recesses when the stock is in the assembled state.

Example 7 includes the subject matter of Example 6, wherein the longitudinal opening is a first longitudinal opening, the tongue further defining a second longitudinal opening intersecting the first plurality of concave recesses, and a third longitudinal opening intersecting the second plurality of concave recesses.

Example 8 includes the subject matter of any of Examples 1-7, wherein in the assembled state with the locking assembly in the locked position, a principal surface of the tongue facing the stock body is spaced from the body by a gap.

Example 9 includes the subject matter of any of Examples 1-8, wherein the locking assembly comprises a thumb screw, wherein advancing the thumb screw draws together the chamfered outside edges on the tongue and the chamfered inside edges along the slot opening.

Example 10 includes the subject matter of any of Examples 1-9, wherein the locking assembly comprises a cam lever operable between a first position and a second position, wherein moving the cam lever to the first position draws together the chamfered outside edges on the tongue and the chamfered inside edges along the slot opening.

Example 11 includes the subject matter of any of Examples 1-11, wherein the body includes a top portion defining at least one post opening extending down into the top portion, the body further defining a longitudinal slit opening extending vertically through the top portion between opposite lateral sides of the top portion and in communication with the at least one post opening, and wherein the adjustable firearm stock further comprises a comb assembly comprising a cheek plate; and at least one post attached to and extending down from the cheek plate, the at least one post sized to be slidably received in the at least one post opening; and a comb lever assembly comprising a fastener extending crosswise through the top portion of the body and the longitudinal slit opening; and a lever attached to the fastener and operable between a locked position and an unlocked position, wherein moving the lever to the locked position draws towards one another the opposite lateral sides of the top portion, thereby constricting the at least one post opening.

Example 12 is an assembly having an adjustable length, the assembly comprising a tongue with a longitudinal planar shape, the tongue having top and bottom chamfered outside edges; a body defining a slot opening sized to receive the tongue, the body having top and bottom chamfered inside edges along the slot opening and corresponding to the chamfered outside edges on the tongue; and a locking assembly operable between a locked position and an unlocked position, wherein in the locked position with the tongue received in the slot opening, moving the locking assembly to the locked position draws together the chamfered outside edges on the tongue and the chamfered inside edges along the slot opening.

Example 13 includes the subject matter of Example 12, wherein the tongue defines a longitudinal opening extending generally parallel to the chamfered outside edges; wherein the locking assembly includes a threaded fastener and a nut; and wherein in an assembled state with the tongue is received in the slot opening, the threaded fastener extends through the longitudinal opening in the tongue, through the body, and into the nut on a first side of the body.

Example 14 includes the subject matter of Example 13 and further comprises a locking plate with a protrusion and a fastener opening; wherein in the assembled state, the locking plate is positioned on an opposite second side of the body with the tongue between the body and the locking plate, a portion of the locking plate in contact with the body, and the threaded fastener extending through the fastener opening in the locking plate; and wherein moving the locking assembly to the locked position draws the protrusion on locking plate into engagement with the tongue.

Example 15 includes the subject matter of Example 14, wherein the protrusion has a convex shape and the tongue defines a plurality of concave recesses along the longitudinal opening, the concave recesses shaped to mate with the convex shape of the protrusion.

Example 16 includes the subject matter of Example 15, wherein the plurality of concave recesses includes a first plurality of concave recesses linearly aligned along a first side of the longitudinal opening and a second plurality of concave recesses linearly aligned along an opposite second side of the longitudinal opening; wherein the protrusion on the locking plate is a first protrusion and the locking plate includes a second protrusion, wherein the first protrusion is positioned to engage one of the first plurality of concave recesses and a second protrusion is positioned to engage one of the second plurality of concave recesses when the assembly is in the assembled state.

Example 17 includes the subject matter of Example 16, wherein the longitudinal opening is a first longitudinal opening, the tongue further defining a second longitudinal opening overlapping the first plurality of concave recesses, and a third longitudinal opening overlapping the second plurality of concave recesses.

Example 18 includes the subject matter of any of Examples 14-17, wherein the portion of the locking plate in contact with the body includes a first tab extending from a first end of the locking plate and a second tab extending from a second end of the locking plate, the first tab and the second tab linearly aligned along a tab axis; and wherein the fastener opening through the locking plate is between the vertical tab axis and an axis defined by the first and second protrusions.

Example 19 includes the subject matter of Example 18, wherein the body defines a first tab recess and a second tab recess, the first tab received in the first tab recess and the second tab received in the second tab recess when the clamping assembly is in the assembled state such that the locking plate can pivot about the tab axis.

Example 20 includes the subject matter of any of Examples 12-19, wherein in the assembled state with the locking assembly in the locked position, a principal surface of the tongue facing the body is spaced from the body by a gap.

Example 21 includes the subject matter of any of Examples 12-20, wherein the locking assembly comprises a thumb screw.

Example 22 includes the subject matter of any of Examples 12-20, wherein the locking assembly comprises a cam lever.

Example 23 includes the subject matter of any of Examples 12-21 and further comprises a butt plate attached to the tongue, wherein the body is part of a rifle stock configured to extend between a firearm and a user of the firearm.

Example 24 includes the subject matter of Example 23, wherein the body has a top portion and a proximal end portion defining the slot opening, the top portion defining a first post opening and a second post opening extending down into the top portion of the stock body, and a slit opening extending between and connecting the first post opening and the second post opening. The rifle stock further comprises a comb assembly including a cheek plate; a first post and a second post attached to and extending down from the cheek plate, the second post parallel to and spaced from the first post; wherein the first post and the second post are sized to be slidably received in the first post opening and the second post opening, respectively; and a comb lever assembly that includes a fastener with threads and a fastener head; a nut threaded to engage the threads on the fastener; a lever configured to be operatively attached to the fastener and operable between a locked position and an unlocked position, wherein the fastener extends crosswise through the top portion of the body at a location between the first and second post openings, and an end of the fastener engaging the nut on a side of the top portion; and wherein moving the lever to the locked position temporarily deforms the top portion of the body to more tightly engage the first and second posts on the cheek plate.

Example 25 includes the subject matter of Example 24, wherein the body defines a void below the top portion and wherein the slit opening extends through the top portion to the void.

Example 26 includes the subject matter of Examples 24 or 25, wherein moving the lever to the locked position draws together opposite sides of the top portion along the slit opening, thereby constricting the first and second post openings.

Example 27 includes the subject matter of Example 26, wherein moving the lever between the locked position and the unlocked position involves pivoting the lever from 45 to 180 degrees about the fastener head.

Example 28 includes the subject matter of any of Example 24-27, wherein the fastener head has a star shape with at least 10 points.

Example 29 includes the subject matter of Example 28, wherein the star shape has at least 15 points.

Example 30 includes the subject matter of Example 28, wherein the star shape has at least 19 points.

Example 31 includes the subject matter of any of Examples 28-30, wherein the lever has a lever head with an inside surface defining facets configured to mate with the star shape of fastener head.

Example 32 includes the subject matter of Example 31, wherein the lever head is removably secured to the fastener head.

Example 33 includes the subject matter of Example 29, further comprising a machine screw securing the lever head to the fastener head.

Example 34 includes the subject matter of any of Examples 24-31, wherein the lever is permanently attached to the fastener.

Example 35 includes the subject matter of any of Examples 24-34, wherein the body is made of metal.

Example 36 includes the subject matter of any of Examples 24-34, wherein the body comprises one or more of a polymer composite, a plastic, and a carbon fiber composite.

Example 37 includes the subject matter of any of Examples 24-36 further comprising a mounting bracket on a distal end of the body, the mounting bracket configured for securing the stock to a firearm.

Example 38 is a rifle comprising the assembly of any of Examples 12-37.

Example 39 is firearm stock with an adjustable comb, the stock comprising a stock body with a top portion defining at least one post opening extending down into the top portion of the stock body, the stock body further defining a longitudinal slit opening extending vertically through the top portion between opposite lateral sides of the top portion and in communication with the at least one post opening; a comb assembly comprising a cheek plate; and at least one post attached to and extending down from the cheek plate, the at least one post sized to be slidably received in the at least one post opening; and a comb lever assembly comprising a fastener extending crosswise through the top portion of the body and the longitudinal slit opening; and a lever attached to the fastener and operable between a locked position and an unlocked position, wherein moving the lever to the locked position draws towards one another the opposite lateral sides of the top portion, thereby constricting the at least one post opening.

Example 40 includes the subject matter of Example 39, wherein the stock body defines a void below the top portion and wherein the slit opening extends vertically through the top portion to the void.

Example 41 includes the subject matter of any of Examples 39-41, wherein the moving the lever between the locked position and the unlocked position includes rotating the fastener from 45 to 180 degrees.

Example 42 includes the subject matter of any of Examples 39-41, wherein the fastener head has a star shape with at least 8 points.

Example 43 includes the subject matter of Example 42, wherein the star shape has at least 15 points.

Example 44 includes the subject matter of Example 42, wherein the star shape has 19 points or more.

Example 45 includes the subject matter of any of Examples 42-44, wherein the lever includes a lever head with an inside surface defining facets configured to mate with the star shape of fastener head.

Example 46 includes the subject matter of Example 45, wherein the lever head is removably secured to the fastener head.

Example 47 includes the subject matter of Example 46 and further comprises a machine screw retaining the lever head to the fastener head.

Example 48 includes the subject matter of Example 47, wherein the machine screw extends through the lever head and into the fastener head, thereby retaining the lever head on the fastener head.

Example 49 includes the subject matter of any of Examples 39-46, wherein the lever is permanently attached to the fastener.

Example 50 includes the subject matter of any of Examples 39-49, wherein the stock body is made of metal.

Example 51 includes the subject matter of any of Examples 39-49, wherein the stock body comprises one or more of a polymer composite, a plastic, and a carbon fiber composite.

Example 52 includes the subject matter of any of Examples 39-51 further comprising a mounting bracket on a distal end of the stock, the mounting bracket configured for securing the stock to a firearm.

Example 53 includes the subject matter of any of Examples 39-52 and further comprises a butt plate with a tongue extending from the butt plate, the tongue having a longitudinal planar shape with top and bottom chamfered outside edges, wherein the stock body defines a slot opening extending into the stock body through a proximal end of the stock body, the slot opening sized to receive the tongue and having top and bottom chamfered inside edges corresponding to the chamfered outside edges on the tongue; and a locking assembly operable between a locked position and an unlocked position, wherein in the locked position with the tongue received in the slot opening, moving the locking assembly to the locked position draws together the chamfered outside edges on the tongue and the chamfered inside edges along the slot opening.

Example 54 includes the subject matter of Example 53, wherein the tongue defines a longitudinal opening extending generally parallel to the chamfered outside edges; wherein the second locking assembly includes a second threaded fastener and a second nut; and wherein in an assembled state with the tongue is received in the slot opening, the second threaded fastener extends through the longitudinal opening in the tongue, through the stock body, and into the second nut on a first side of the stock body.

Example 55 includes the subject matter of Example 54 and further comprises a locking plate with a protrusion and a fastener opening; wherein in the assembled state, the locking plate is positioned on an opposite second side of the stock body with the tongue between the stock body and the locking plate, a portion of the locking plate in contact with the stock body, and the second threaded fastener extending through the fastener opening in the locking plate; and wherein moving the second locking assembly to the locked position draws the protrusion on locking plate into engagement with the tongue.

Example 56 includes the subject matter of Example 55, wherein the protrusion on the locking plate has a convex shape and the tongue defines a plurality of concave recesses along the longitudinal opening, the concave recesses shaped to mate with the convex shape of the protrusion.

Example 57 includes the subject matter of Example 56, wherein the plurality of concave recesses includes a first plurality of concave recesses linearly aligned along an upper side of the longitudinal opening and a second plurality of concave recesses linearly aligned along a lower side of the longitudinal opening; and wherein the protrusion on the locking plate is a first protrusion and the locking plate includes a second protrusion, wherein the first protrusion is positioned to engage one of the first plurality of concave recesses and a second protrusion is positioned to engage one of the second plurality of concave recesses when the stock is in the assembled state.

Example 58 includes the subject matter of Example 57, wherein the longitudinal opening is a first longitudinal opening, the tongue further defining a second longitudinal opening overlapping the first plurality of concave recesses, and a third longitudinal opening overlapping the second plurality of concave recesses.

Example 59 includes the subject matter of any of Examples 55-58, wherein the portion of the locking plate in contact with the stock body includes a first tab extending from an upper end of the locking plate and a second tab extending from a lower end of the locking plate, the first tab and the second tab linearly aligned along a vertical tab axis; and wherein the fastener opening through the locking plate is between the vertical tab axis and an axis defined by the first and second protrusions.

Example 60 includes the subject matter of Example 59, wherein the stock body defines a first tab recess and a second tab recess, the first tab received in the first tab recess and the second tab received in the second tab recess when the stock is in the assembled state such that the locking plate can pivot about the tab axis.

Example 61 includes the subject matter of any of Examples 53-60, wherein in the assembled state with the second locking assembly in the locked position, a principal surface of the tongue facing the stock body is spaced from the stock body by a gap.

Example 62 includes the subject matter of any of Examples 53-61, wherein the second locking assembly comprises a thumb screw.

Example 63 includes the subject matter of any of Examples 53-61, wherein the second locking assembly comprises a cam lever.

Example 64 is a rifle comprising the stock of any of Examples 39-61.

Example 65 includes the subject matter of Example 64, wherein the rifle is configured to engage targets at a distance of at least 500 yards.

Example 66 includes the subject matter of Examples 64 or 65 and further comprises a scope mounted along a top of the rifle.

Example 67 is a method of securing an adjustable assembly, the method comprising providing a body defining a slot opening with inside chamfers; providing a tongue defining a fastener opening and outside chamfers and; providing a locking plate with protrusions and fastener opening; providing a fastener and a nut; and advancing the fastener, thereby drawing the protrusions against the tongue and the outside chamfers against the inside chamfers.

Example 68 includes the subject matter of Example 67 and further comprises installing the tongue in the slot opening with the outside chamfers along the inside chamfers; positioning the locking plate so the protrusions engage the tongue; installing the fastener through the locking plate; and installing the nut on the fastener;

Example 69 is a method of adjusting a comb height on a firearm stock, the method comprising providing a stock body with post openings extending vertically into an upper portion of the stock body and a slit opening extending vertically through the upper portion and longitudinally between and connecting the post openings; providing a cheek plate with posts received in the post openings; providing a locking assembly with a fastener and a lever operably coupled to the fastener, the fastener extending crosswise through the upper portion of the stock body between the post openings; moving the lever to an unlocked position; adjusting a position of the posts in the post openings; and moving the lever to a locked position, thereby drawing towards one another opposite side portions of the upper portion of the stock body.

Example 70 includes the subject matter of Example 69, wherein moving the lever to the unlocked position is performed by pivoting a lever handle about the fastener an amount from 45° to 200°.

Example 71 includes the subject matter of Example 70, wherein the amount is from 90° to 180°.

Example 72 includes the subject matter of any of Examples 69-71, wherein the fastener includes a fastener head with at least 15 points, and wherein the lever includes a lever head with facets corresponding to points of the fastener head.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. An adjustable firearm stock comprising:

a tongue with a longitudinal planar shape, the tongue having top and bottom chamfered outside edges;

a body defining a slot opening extending into the body through a proximal end of the body, the slot opening sized to receive the tongue and having top and bottom chamfered inside edges corresponding to the chamfered outside edges on the tongue; and a locking assembly operable between a locked position and an unlocked position, wherein in the locked position with the tongue received in the slot opening, moving the locking assembly to the locked position draws together the chamfered outside edges on the tongue and the chamfered inside edges along the slot opening.

2. The adjustable firearm stock of claim 1, wherein the tongue defines a longitudinal opening extending generally parallel to the chamfered outside edges;

wherein the locking assembly includes a threaded fastener and a nut; and wherein in an assembled state with the tongue received in the slot opening, the threaded fastener extends through the longitudinal opening in the tongue, through the body, and into the nut on a first side of the body.

3. The adjustable firearm stock of claim 2 further comprising:

a locking plate with at least one protrusion and a fastener opening; and wherein in the assembled state, the locking plate is positioned on an opposite second side of the body with the tongue between the body and the locking plate, a portion of the locking plate in contact with the body, and the threaded fastener extending through the fastener opening in the locking plate;

wherein moving the locking assembly to the locked position draws the at least one protrusion on the locking plate into engagement with the tongue.

4. The adjustable firearm stock of claim 3, wherein the portion of the locking plate in contact with the body includes a first tab extending from an upper end of the locking plate and a second tab extending from a lower end of the locking plate, the first tab and the second tab linearly aligned along a tab axis; and wherein the body defines a first tab recess and a second tab recess, the first tab received in the first tab recess and the second tab received in the second tab recess when the clamping assembly is in the assembled state such that the locking plate can pivot about the tab axis.

5. The adjustable firearm stock of claim 3, wherein the at least one protrusion has a convex shape and the tongue defines a plurality of concave recesses along the longitudinal opening, the concave recesses sized and configured to mate with the convex shape of the at least one protrusion.

6. The adjustable firearm stock of claim 5, wherein the plurality of concave recesses includes a first plurality of concave recesses above and linearly aligned along the longitudinal opening and a second plurality of concave recesses below and linearly aligned along the longitudinal opening;

wherein the at least one protrusion on the locking plate includes a first protrusion and a second protrusion, wherein the first protrusion is positioned to engage one of the first plurality of concave recesses and a second protrusion is positioned to engage one of the second plurality of concave recesses when the assembly is in the assembled state.

7. The adjustable firearm stock of claim 6, wherein the longitudinal opening is a first longitudinal opening, the tongue further defining a second longitudinal opening intersecting the first plurality of concave recesses, and a third longitudinal opening intersecting the second plurality of concave recesses.

8. The adjustable firearm stock of claim 1, wherein in the assembled state with the locking assembly in the locked position, a principal surface of the tongue facing the body is spaced from the body by a gap.

9. The adjustable firearm stock of claim 1, wherein the locking assembly comprises a thumb screw, wherein advancing the thumb screw draws together the chamfered outside edges on the tongue and the chamfered inside edges along the slot opening.

10. The adjustable firearm stock of claim 1, wherein the locking assembly comprises a cam lever operable between a first position and a second position, wherein moving the cam lever to the first position draws together the chamfered outside edges on the tongue and the chamfered inside edges along the slot opening.

11. The adjustable firearm stock of claim 1, wherein the body includes a top portion defining at least one post opening extending down into the top portion, the body further defining a longitudinal slit opening extending vertically through the top portion between opposite lateral sides of the top portion and in communication with the at least one post opening, and wherein the adjustable firearm stock further comprises:

a comb assembly comprising a cheek plate; and at least one post attached to and extending down from the cheek plate, the at least one post sized to be slidably received in the at least one post opening; and a comb lever assembly comprising a fastener extending crosswise through the top portion of the body and the longitudinal slit opening; and a lever attached to the fastener and operable between a locked position and an unlocked position, wherein moving the lever to the locked position draws towards one another the opposite lateral sides of the top portion, thereby constricting the at least one post opening.

12. A firearm stock with an adjustable comb, the stock comprising:

a stock body with a top portion defining at least one post opening extending down into the top portion of the stock body, the stock body further defining a longitudinal slit opening extending vertically through the top portion between opposite lateral sides of the top portion and in communication with the at least one post opening;

a comb assembly comprising a cheek plate; and at least one post attached to and extending down from the cheek plate, the at least one post sized to be slidably received in the at least one post opening; and a comb lever assembly comprising a fastener extending crosswise through the top portion of the body and the longitudinal slit opening; and a lever attached to the fastener and operable between a locked position and an unlocked position, wherein moving the lever to the locked position draws towards one another the opposite lateral sides of the top portion, thereby constricting the at least one post opening.

13. The stock of claim 12, wherein moving the lever between the locked position and the unlocked position involves rotating the fastener from 45 to 180 degrees.

14. The stock of claim 13, wherein the fastener includes a fastener head having a star shape with at least 8 points.

15. The stock of claim 14, wherein the lever includes a lever head with an inside surface defining facets configured to mate with the star shape of fastener head.

16. The stock of claim 15, wherein the lever head is removably secured to the fastener head.

17. The stock of claim 16 further comprising a machine screw extending through the lever head and into the fastener head, thereby retaining the lever head on the fastener head.

18. The stock of claim 12 further comprising:

a tongue with a longitudinal planar shape, the tongue having top and bottom chamfered outside edges, wherein the stock body defines a slot opening extending into the stock body through a proximal end of the stock body, the slot opening sized to receive the tongue and having top and bottom chamfered inside edges corresponding to the chamfered outside edges on the tongue; and a locking assembly operable between a locked position and an unlocked position, wherein in the locked position with the tongue received in the slot opening, moving the locking assembly to the locked position draws together the chamfered outside edges on the tongue and the chamfered inside edges along the slot opening.

* * * * *